US006371080B1

(12) United States Patent
Saito et al.

(10) Patent No.: US 6,371,080 B1
(45) Date of Patent: Apr. 16, 2002

(54) THROTTLE DEVICE FOR INTERNAL-COMBUSTION ENGINE

(75) Inventors: Yasuo Saito, Hitachinaka; Yoshikatsu Hashimoto, Hitachiota; Eisuke Wayama; Toshifumi Usui, both of Hitachinaka, all of (JP)

(73) Assignees: Hitachi, Ltd., Tokyo; Hitachi Car Engineering Co., Ltd., Hitachinaka, both of (JP)

( * ) Notice: Subject to any disclaimer, the term of this patent is extended or adjusted under 35 U.S.C. 154(b) by 0 days.

(21) Appl. No.: 09/930,273

(22) Filed: Aug. 16, 2001

Related U.S. Application Data

(62) Division of application No. 09/462,864, filed on Jan. 18, 2000.

(51) Int. Cl.[7] ..... F02D 9/10
(52) U.S. Cl. ..... 123/337; 123/361; 123/399
(58) Field of Search ..... 123/399, 361, 123/337

(56) References Cited

U.S. PATENT DOCUMENTS

| | | | | |
|---|---|---|---|---|
| 4,735,179 A | | 4/1988 | Ejira et al. | 123/332 |
| 4,938,190 A | * | 7/1990 | McCabe | 123/399 |
| 4,947,815 A | | 8/1990 | Peter | 123/399 |
| 5,738,072 A | * | 4/1998 | Bolte et al. | 123/399 |
| 6,109,240 A | * | 8/2000 | Sato et al. | 123/399 |

FOREIGN PATENT DOCUMENTS

| | | |
|---|---|---|
| JP | 62-82238 | 4/1987 |
| JP | 63-150449 | 6/1988 |
| JP | 1-85432 | 6/1989 |
| JP | 10-89096 | 4/1998 |
| JP | 10-131771 | 5/1998 |
| JP | 11-190232 | 7/1999 |

* cited by examiner

*Primary Examiner*—Erick Solis
(74) *Attorney, Agent, or Firm*—Crowell & Moring LLP

(57) ABSTRACT

Disclosed is a throttle device for an internal-combustion engine, in which, on one side of the side wall of a throttle body, there are formed a space for mounting a reduction gear mechanism which transmits the power from a motor to a throttle valve shaft and a default opening setting mechanism for holding a throttle valve opening at a specific opening (default opening) when the ignition switch is in off position, and a gear cover mounting frame which edges the mounting space. The frame is formed lower than the mounting level of the reduction gear mechanism. A gear cover for covering the gear mounting space is attached on the frame. A stopper for defining the default opening and a stopper for defining the full-closed position of the throttle valve are juxtaposed so as to enable position adjustments in the same direction. These stoppers serve to stop a default lever and a throttle gear, thereby enabling downsizing, weight reduction, and rationalization of fabrication and adjustments of an electronically controlled throttle device.

3 Claims, 26 Drawing Sheets

THROTTLE DEVICE FOR INTERNAL-COMBUSTION ENGINE

This application is a divisional of Ser. No. 09/462,864 filed Jan. 18, 2000.

BACKGROUND OF THE INVENTION

1. Field of the Invention

This invention relates to a throttle device for an internal-combustion engine and, more particularly, to an electronically controlled throttle device which controls the opening and closing operation of a throttle valve by driving an electric actuator according to a control signal.

2. Description of Related Art

In an electronically controlled throttle device which controls an engine throttle valve by driving an electric actuator (e.g., a D C motor and a stepping motor), there has been known such a technology that the amount of initial opening (default opening) of the throttle valve is set larger than a full-closed position when an ignition switch is in off position (in other words, when no current is being supplied to the electric actuator).

Here, the full-closed position of the throttle valve is not meant by a position in which the intake air passage is full-closed; especially in a throttle device having no bypass around the throttle valve and controlling the idling speed only by means of the throttle valve, the full-closed position is defined as a mechanically full-closed position and an electrically full-closed position which will be described below.

The mechanically full-closed position is the minimum opening position of the throttle valve defined by a stopper. The minimum opening is set at a position where the intake air passage is slightly opened from a full-closed position to thereby prevent the throttle valve from galling. The electrically full-closed position is the minimum opening position within the range of opening used in engine control, and is set, by the control of the electric actuator, at a position of a slightly wider opening than the mechanically full-closed position (e.g., about 1 deg. larger than the mechanically full-closed position).

In the electronically controlled throttle, the electrically full-closed position (the minimum opening for control) and the idle opening (an opening required for controlling the idle speed) do not necessarily agree. This is because the amount of opening of the throttle valve is controlled by a feed-back control system according to an idle speed detection signal in order to keep a target idle speed, and for this purpose the amount of opening is allowed to vary.

The full-open position has also a mechanically full-open position defined by the stopper and an electrically full-open position in which the throttle valve is opened to the maximum control amount of opening. The full-closed position stated herein includes the mechanically full-closed position and the electrically full-closed position as well. In normal control, the throttle valve is controlled within the range from the electrically full-closed position (the minimum opening for control) to the electrically full-open position (the maximum opening for control), so that a part of the throttle valve shaft will not hit on the stopper which determines the mechanically full-closed and full-open positions, when the throttle valve is being controlled to the minimum or maximum opening. Thus it becomes possible to protect the stopper and throttle components from mechanical fatigue, abrasion, and damage, and also to prevent galling to the stopper.

The default opening (i.e., the initial opening when the ignition switch is in off position) is set to the amount of opening of the throttle valve which is opened wider than the full-closed position (the mechanically full-closed position and the electrically full-closed position) (e.g. 4 to 13 deg. wider than the mechanically full-closed position).

The default opening is set from the reason for achieving the air flow rate necessary for fuel combustion for operation to be performed prior to engine warm-up at the time of engine starting (cold starting) without providing an auxiliary air passage (an air passage bypassing the throttle valve). During idling, the throttle valve is controlled towards decreasing the amount of opening from the default opening as the engine warm-up proceeds (in this case, however, the electrically full-closed position is the lower limit position).

Furthermore, the default opening is adopted to meet requirements for insuring self-running (limping home) in the event of a throttle control system trouble or insuring an intake air flow rate necessary for preventing an engine stop, and for preventing the throttle valve from being stuck with a viscous substance, ice, or other, on the inside wall of the throttle body.

As a conventional example of a default opening setting mechanism, various mechanisms have been proposed.

A known prior art has been stated in, for example, Japanese Laid-Open No. Sho 63-150449 Patent Publication, U.S. Pat. No. 4,947,815 specification ,Japanese Translation of PCT Application No. Hei 2-500677 corresponding to the US patent, Japanese Laid Open No. Sho 62-82238 Patent Publication and its corresponding U.S. Pat. No. 4,735,179 specification, Japanese Laid-Open No. Hei 10-89096 Patent Publication, and Japanese Laid Open No. Hei 10-131771 Patent Publication.

There are various types of default opening setting mechanisms, a typical type of which for example is as follows.

One type is of such a system that a default opening setting engagement element (a default lever) which is fitted on the throttle valve to enable the rotation of the engagement element on the throttle valve shaft is engaged via a spring with an element secured on the throttle valve, thereby allowing the default lever to turn together with the throttle valve shaft between the range from the default opening position to the valve full-open position. When the ignition switch is in off position, the default lever is held in contact with the default stopper, to thereby hold the throttle valve opening at the default opening. To close the throttle valve to the default opening or less, the default lever is disengaged from the throttle valve shaft to allow the throttle valve shaft to rotate independently against a spring force towards closing the throttle valve.

Another type is of such a system that, reversely to the above-described system, the default lever and the throttle valve shaft are turned together from the throttle valve full-close position to the default opening position. When the ignition switch is off, the default lever is held in contact with the default stopper to hold the throttle valve opening at the default opening. When the throttle valve is opened over the throttle opening, the default lever is disengaged from the throttle valve shaft, to allow the throttle valve shaft to turn towards opening independently against the spring force.

The electronically controlled throttle device can perform more accurately the air flow rate control suitable for the operation of the internal-combustion engine than a mechanical throttle device which transmits the amount of depression of the accelerator pedal to the throttle valve shaft through an accelerator cable. The component count is increased to provide an electric actuator, a default opening setting mechanism, and a throttle sensor. Therefore, downsizing, weight reduction and simplification, rationalization of fabrication and adjustment jobs, and further improvement in operation stability and accuracy of the throttle body, are demanded.

SUMMARY OF THE INVENTION

To solve the above-described problem, therefore, it is an object of the invention to realize the downsizing, weight reduction and simplification of the throttle body equipped with an electric actuator, a gear mechanism and a default opening setting mechanism, the rationalization of fabrication and adjustment jobs, and further improvement in operation stability and accuracy.

This invention basically has the following constitution.

The first aspect of the invention pertains to the throttle device for an internal-combustion engine which is driven by an electric actuator to open and close the throttle valve to thereby control the amount of intake air aspirated by the internal-combustion engine. In the throttle device, there are formed, on one surface of the side wall of the throttle body, a reduction gear mechanism mounting space which transmits to the throttle valve shaft the power of the electric actuator, and a frame for mounting a gear cover formed to define the space for mounting the reduction gear mechanism. The frame is built lower than the mounting height of the gear mounted on one end of the throttle valve shaft. On the frame is attached the gear cover for covering reduction gear mechanism mounting space.

According to the above-described constitution, the reduction gear mechanism mounting space is covered with a gear cover, which covers most of the mounting space, in place of a gearcase and a gear cover mounted on the side wall of a conventional throttle body. In this sense, the gear cover plays a role of the gearcase. Unlike the conventional type, therefore, the throttle body itself is not needed to be formed integrally with a gearcase having a relatively large volume, A gear cover made of a synthetic resin should be increased in the volume; generally, therefore, it is possible to reduce the size and weight of the metal throttle body formed by mold casting.

The second aspect of the invention pertains to the throttle device of the internal-combustion engine having the default opening setting mechanism to hold the amount of opening of the throttle valve at a specific opening (the default opening) which is larger than the full-close position when the electric actuator is off.

In this throttle device, the stopper for defining the default opening position and the stopper for defining the mechanically full-closed position of the throttle valve are comprised of adjusting screws. These stoppers are so juxtaposed as to enable adjustment of their position in the same direction.

According to the above-described constitution, it is possible to freely adjust the default opening and the mechanical full-closed position of the throttle valve. Besides, since the adjusting screw of the default opening stopper (the default stopper) and the adjusting screw of the full-closed stopper are juxtaposed to allow position adjustment from the same direction, it is possible to drill screw holes for these stoppers (screws) in the same direction, and moreover to perform the adjustment of the stopper positions in close positions from the same direction, thereby enabling simplification of adjustment jobs.

The third aspect of the invention is application of the first and second aspects of the invention, pertaining to the throttle device of the internal-combustion engine. In the aspect, the full-closed stopper stops the reduction gear (the final gear) fixedly attached on the throttle valve shaft, to thereby define the mechanical full-closed position, while the default stopper stops an engagement element for setting the default opening (this engagement element is a default lever freely fitted on the throttle valve shaft to enable rotation of the shaft and engaged with the final gear through a spring), thus defining the default opening.

In the throttle device, there are formed, on one surface of the side wall of the throttle body, a space for mounting a reduction gear mechanism which transmits to the throttle valve shaft the power of the electric actuator, and a frame for mounting a gear cover formed to define the space for mounting the reduction gear. The frame is built lower than the mounting height of the final gear. In the position covered by the gear cover, there is provided a projecting portion, which is higher than the frame, for mounting the full-closed stopper. Mounted on this projecting portion is the full-closed stopper, at the same mounting height as the final gear of the reduction gear. On the other hand, the default stopper is juxtaposed with the full-closed stopper at the position of the said engagement element (the default lever) which is located at the lower level than the said frame.

According to the above-described constitution, the space for mounting the reduction gear mechanism is covered almost by the gear cover like in the first aspect of the invention. It is, therefore, possible to reduce the size and weight of the metal throttle body.

The final gear of the reduction gear protrudes out of the gear cover mounting frame on the throttle body side wall; therefore, the final gear can not be stopped if the full-closed stopper is provided on this frame. In the aspect, there is provided a projecting portion for mounting the full-closed stopper which stops the final gear. The projecting portion protrudes high over the frame. On this projecting portion the full-closed stopper is arranged at the same mounting height as the final gear.

According to this arrangement, it is possible to stop the final gear by the full-closed stopper if the gear cover mounting frame is built low.

The fourth aspect of the invention pertains to a throttle device for an internal-combustion engine having the default opening setting mechanism.

The throttle valve shaft protrudes out at one end from the bearing boss formed on the throttle body side wall, and the final gear of the reduction gear for transmitting the power of the electric actuator is fixedly attached on the one end of the throttle valve shaft. Between the final gear and the bearing boss, the engagement element (the default lever) of the default opening setting mechanism capable of engaging with the final gear is rotatable with respect to the throttle valve shaft.

A return spring is arranged around the bearing boss for exerting the spring force to the throttle valve in the direction the throttle valve is closed. The return spring engages at one end with the default lever; and between the default lever and the final gear there is mounted a spring (the default spring) for attracting the default lever and the final gear towards mutual engagement.

A throttle valve shaft insertion boss is formed only on the surface side (one surface side) of the final gear which receives the default spring. The default lever also has a throttle valve shaft insertion boss formed correspondingly to the final gear boss. And around these bosses the default spring mounted.

According to the above-described constitution, the return spring and the default spring can be installed in a free space inevitably formed around each boss. That is, rational utilization of space is realized. Moreover, since the boss of the final gear of the reduction gear is protrusively formed on one side only, the amount of projection of the boss (the length of boss axis) protruding out from one side of the final gear can be made longer than the amount of projection of the boss on one side of double-sided bosses (bosses protruded on both sides of the final gear). Therefore, it becomes possible to provide the default opening setting mechanism with a spring mounting space without wasted space while realizing a downsized throttle device.

The fifth aspect of the invention pertains to a throttle device for an internal-combustion engine having the default opening setting mechanism.

In the throttle device, the final gear of the reduction gear which transmits the power of the electric actuator is secured on one end of the throttle valve shaft, and the engagement element (the default lever) of the default opening setting mechanism is relatively rotatably fitted on the throttle valve shaft.

Between the default lever and the final gear there is installed a spring (a default spring) for setting the default opening which pulls the default lever and the final gear towards mutual engagement. The default spring is characterized by the spring stop mechanism that the default spring is supported by the default lever and the final gear.

According to the above-described constitution, the default lever and the final gear of the reduction gear serve also as a default spring bracket, thereby enabling simplification of component parts.

It is, therefore, proposed as an example of application that at least a portion forming the boss and a portion receiving the default spring of the default lever are made of a synthetic resin.

According to the above-described constitution, since the synthetic resin is of a less coefficient of friction than a metal member, friction between the default spring and a member (the spring stop portion in the default lever, and the boss portion) which contacts the default spring will be decreased to reduce a burden on the motor if the default spring is twisted by the relative rotation of the default lever and the final gear, thereby achieving smooth movement of the throttle valve driven by the motor and a decreased motor power consumption during operation.

Furthermore, the use of the return spring and the default spring coated for reducing a coefficient of friction can further decrease its friction with its mating member in case of distortion of the spring.

The sixth aspect of the invention pertains to a throttle device for an internal-combustion engine having the default opening setting mechanism.

In the throttle device, the engagement element (the default lever) for setting the default opening is fitted on one end of the throttle valve shaft in such a manner that the engagement element can rotate in relation to the throttle valve shaft.

On both sides of the engagement element, the return spring exerting a spring force to turn the throttle valve towards closing and the default opening setting spring (the default spring) exerting the spring force from the full-close position of the throttle valve to the default opening side are oppositely arranged in the direction of the throttle valve shaft. These springs which are torsion coil springs seat on both sides of the engagement element serve as spring stopper, thereby retaining these springs at one end. These springs differ in coil diameter and are axially compressed when installed. Furthermore, the compressive stress F of the spring of large coil diameter is made greater than the compressive stress f of the spring of small coil diameter. The compressive stress of the spring stated above is spring rebound which occurs when the spring is compressed.

The throttle valve shaft is required to be disengaged from the engagement element for setting the default opening and to turn independently when turned within a specific range of throttle valve opening (e.g., from the default opening to the electrically full-closed position, or from the default opening to the electrically full-open position of the throttle valve), and accordingly the engagement element for setting the default opening is attached loose-fit on the throttle valve shaft so that the engagement element can rotate with respect to the throttle valve shaft.

Therefore, there exists a clearance between the outer periphery of the throttle valve shaft and the engagement element for setting the default opening. Therefore, the engagement element for setting the default opening will vary (displace) with vibrations if in an unstable state. If the engagement element for setting the default opening is held by the compressive force of the coil return spring and the default spring, and if the compressive stresses of these springs are equal, and also if these springs get out of balance, the engagement element for setting the default opening is liable to vibrate, becoming unstable. Consequently, the default opening will vary, and no smooth operation of the engagement element can be expected.

In the present invention, to cope with this problem, it is necessary to increase the compressive stress F of the return spring or the default spring having a large coil diameter than the compressive stress f of the spring having a small coil diameter. The compressive force F thus increased can overcome the compressive force f, and unidirectionally press the engagement element in a stable state in a position close to the outside diameter, thereby preventing the engagement element for setting the default opening from displacing to enable to maintain a proper condition and accordingly preventing above-described trouble.

The seventh aspect of the invention pertains to a throttle device for an internal-combustion engine, wherein the throttle device is provided with a reduction gear for transmitting the power of the electric actuator to the throttle valve shaft; the final gear of the reduction gear is pressed in and fixed on one end side protruding out of the side wall surface of the throttle body of the throttle valve shaft; and the final gear thus pressed in and fixed can contact the stopper for defining the mechanical full-closed position of the throttle valve, by driving the electric actuator.

According to the above-described constitution, since the final gear of the reduction gear serves also as a defining element on the movable side which restricts the mechanical full-closed position and also the defining element (the final gear) is pressed in and fixed on the throttle valve shaft, the reduction gear position is constantly held in a fixed relation with the throttle valve shaft even in case of a shock caused by the contact of the reduction gear with the full-closed stopper. Therefore, the throttle valve opening set with reference to the mechanically full-closed position will not vary, thus doing much towards keeping a control accuracy.

The eighth aspect of the invention pertains to a throttle device for an internal-combustion engine which is driven by an electric actuator to open and close the throttle valve to control the amount of intake air being aspirated by the internal-combustion engine.

In the throttle device, the motor used as the electric actuator has a yoke forming a motor housing. The yoke is provided with two opposite flat surfaces. The motor casing containing the motor has flat opposite inner surfaces formed to the contour of the motor housing, and is mounted on the side wall of the throttle body, intersecting the line orthogonal with the throttle valve shaft. Of the opposite flat inner surfaces of the motor casing, all or most part of one inner surface makes up the outside wall surface of the intake air passage downstream of the idle opening position for throttle valve control (e.g., downstream of the electrically full-closed position for throttle valve control).

According to the above-described constitution, using the flat motor housing and accordingly the flat motor casing can contribute to the downsizing of the throttle body. Besides, since one of the flat inner surfaces of the motor casing makes up the outside wall surface of the intake air passage downstream of the idle opening position for throttle valve control, the motor casing is most efficiently cooled by the adiabatic expansion of the intake air occurring downstream immediately after passing the throttle valve during an idle turn even if the intake air flow rate is little like during idle turn. Therefore, The cooling of the motor casing interior and the heat dissipation of the motor housing can be improved, thereby contributing to achieving a higher motor cooling effect.

The ninth aspect of the invention pertains to a throttle device for an internal-combustion engine, in which the motor casing for containing the motor, as previously stated, has opposite flat inner surfaces formed to the contour of the motor housing, and is installed on the side wall of the throttle body, intersecting the line orthogonal with the throttle valve shaft. Of the opposite flat inner surfaces of the motor casing, one inner surface is formed lower than the surrounding outside wall surface of the intake passage.

According to the above-described constitution, the motor casing wall adjacent to the intake passage is decreased in thickness to bring the inner surface of the motor casing closer to the intake passage side, thereby enabling to efficiently benefit from the cooling effect of the intake air passing through the intake air passage.

Other objects and advantages of the invention will become apparent upon reading the detailed description and upon reference to the accompanying drawings.

BRIEF DESCRIPTION OF THE DRAWINGS

FIG. 12 is an explanatory view showing the full-closed stopper and the default stopper in mounted state, in which

DESCRIPTION OF THE PREFERRED EMBODIMENTS

Preferred embodiments of this invention will be explained with reference to the accompanying drawings.

Figure 1:
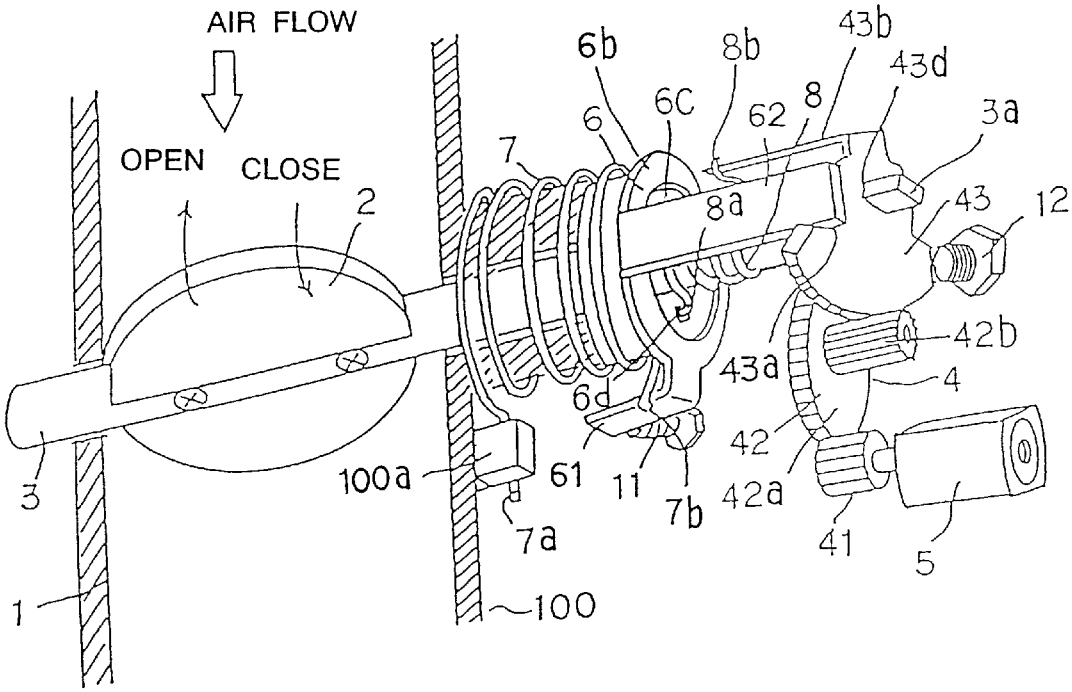
FIG. 1 is a perspective view schematically showing the power transmission and default mechanism of a throttle valve of an electronically controlled throttle device in one embodiment of this invention.

First, referring to FIG. 1 and FIG. 2, the principle of the electronically controlled throttle device (the throttle device of an automotive internal-combustion engine) fitted with a default mechanism pertaining to one embodiment of this invention will be explained. FIG. 1 is a perspective view schematically showing the throttle valve power transmission and default mechanism in the present embodiment; and FIG. 2 is an explanatory view equivalently showing the principle of operation thereof.

In FIG. 1, the amount of air flowing in the direction of the arrow in an intake air passage 1 is adjusted in accordance with the amount of opening of a disk-like throttle valve 2. The throttle valve 2 is secured by a screw to a throttle valve shaft 3. On one end of the throttle valve shaft 3 is mounted a final gear (hereinafter referred to as the throttle gear) 43 of a reduction gear mechanism 4 which transmits the power of the motor (the electric actuator) 5 to the throttle valve shaft 3.

Figure 3:
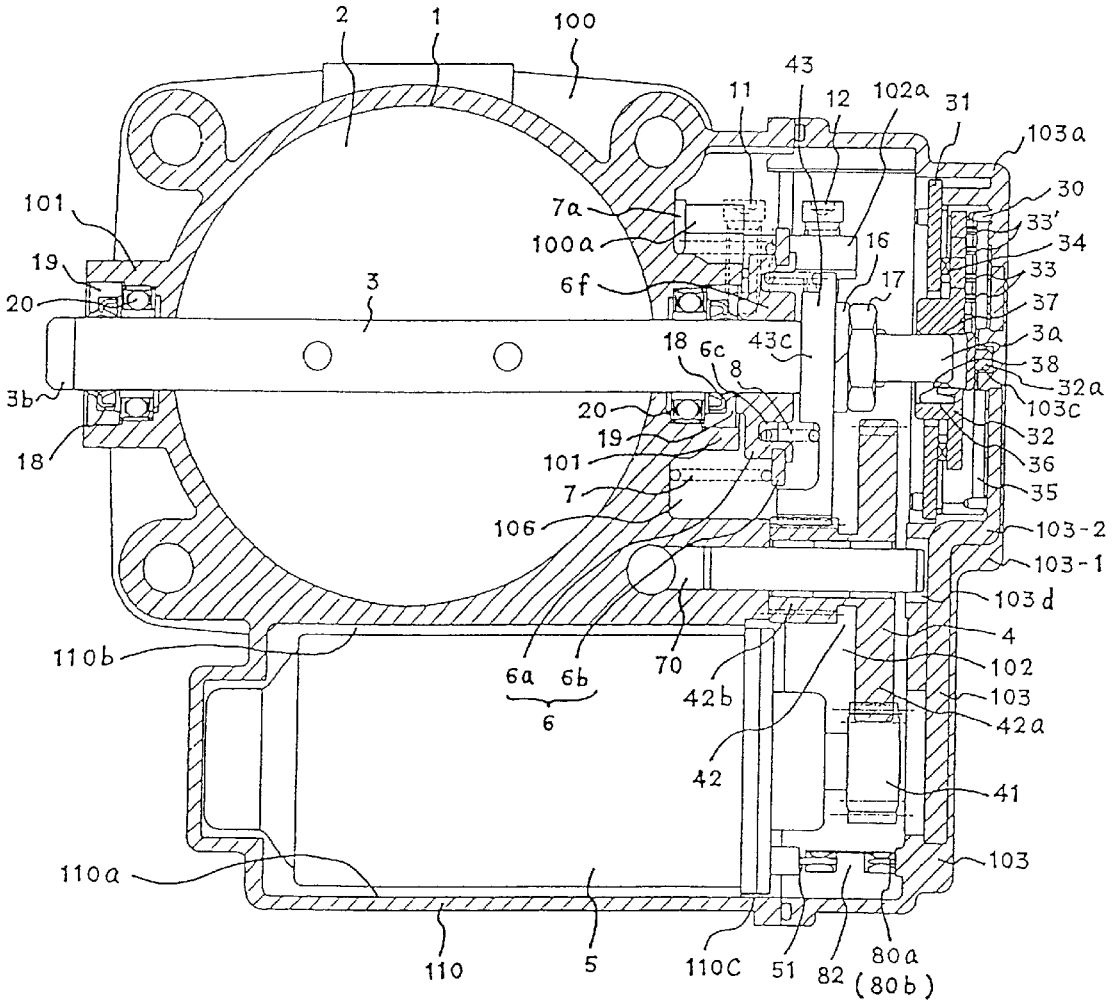
FIG. 3 is a sectional view of the electronically controlled throttle device pertaining to the embodiments taken perpendicularly to the axial direction of the intake passage.

The gear mechanism 4 is comprised of, beside the throttle gear 43, a pinion 41 mounted to the motor 5 and an intermediate gear 42. The intermediate gear 42 includes a large-diameter gear 42*a* which meshes with the pinion gear 41, and a small-diameter gear 42*b* which meshes with the throttle gear 43, both being rotatably mounted on a gear shaft 70 fixedly attached on the wall surface of a throttle body 100 as shown in FIG. 3.

The motor 5 is driven in accordance with an accelerator signal regarding with the amount of depression of the accelerator pedal and a traction control signal; the power from the motor 5 is transmitted to the throttle valve shaft 3 through the gears 41, 42 and 43.

The throttle gear 43 is a sector gear, which is fixed on the throttle valve shaft 3, and has an engagement side 43*a* for engagement with a projecting portion 62 of the default lever 6 described below.

The default lever 6 is for use in the default opening setting mechanism (which serves as an engagement element for setting the default opening), which is rotatably fitted on the throttle valve shaft, to rotate relatively with the throttle valve shaft 3. In the throttle gear 43 and the default lever 6, one end 8*a* of a spring 8 (hereinafter, in some cases, referred to as the default spring) is retained at a spring retaining portion 6*d* of the default lever 6, while the other end 8*b* is retained at a spring retaining portion 43*b* of the throttle gear 43, so that a projecting portion 62 on the default lever 6 side and the engagement side 43*a* on the throttle gear 43 side are applied with a spring force to mutually pull (into engagement) in-the direction of rotation. The default spring 8 functions to turn the throttle valve shaft 3 and accordingly the throttle valve 2 towards the default opening from the full-closed position of the throttle valve.

The return spring 7 gives the throttle valve 3 a return force to turn the throttle valve 3 back towards closing. One end (the fixed end) 7*a* of the return spring 7 is retained at a spring retaining portion 100*a* fixed on the throttle body 100, and the other free end 7*b* is retained on the spring retaining portion (projecting portion) 61 provided on the default lever 6. The default lever 6 and a throttle gear 43 in engagement with the default lever 6 and accordingly the throttle valve shaft 3 are turned towards closing the throttle valve.

Figure 6:
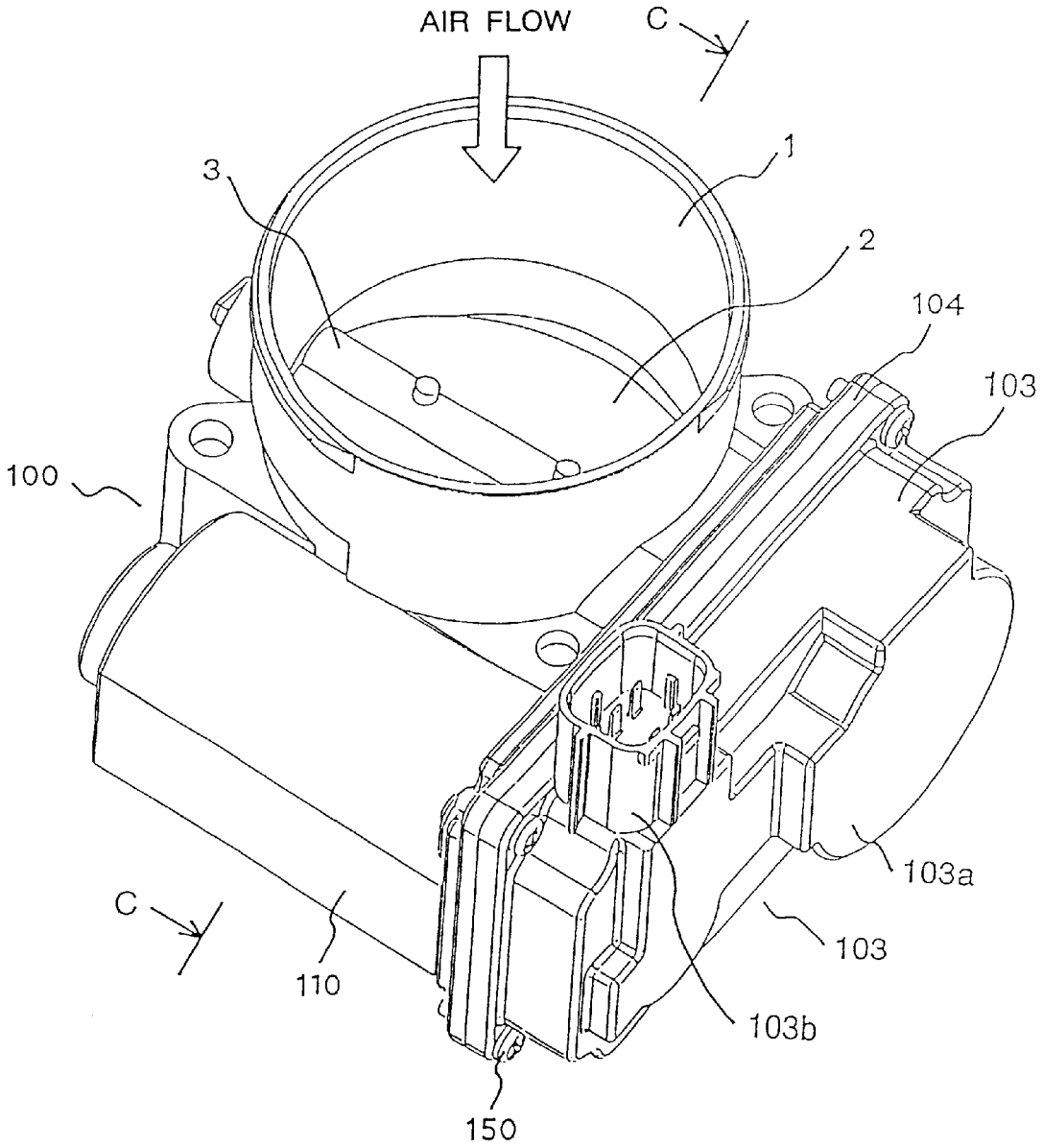
FIG. 6 is a perspective view of the throttle device.
Figure 7:
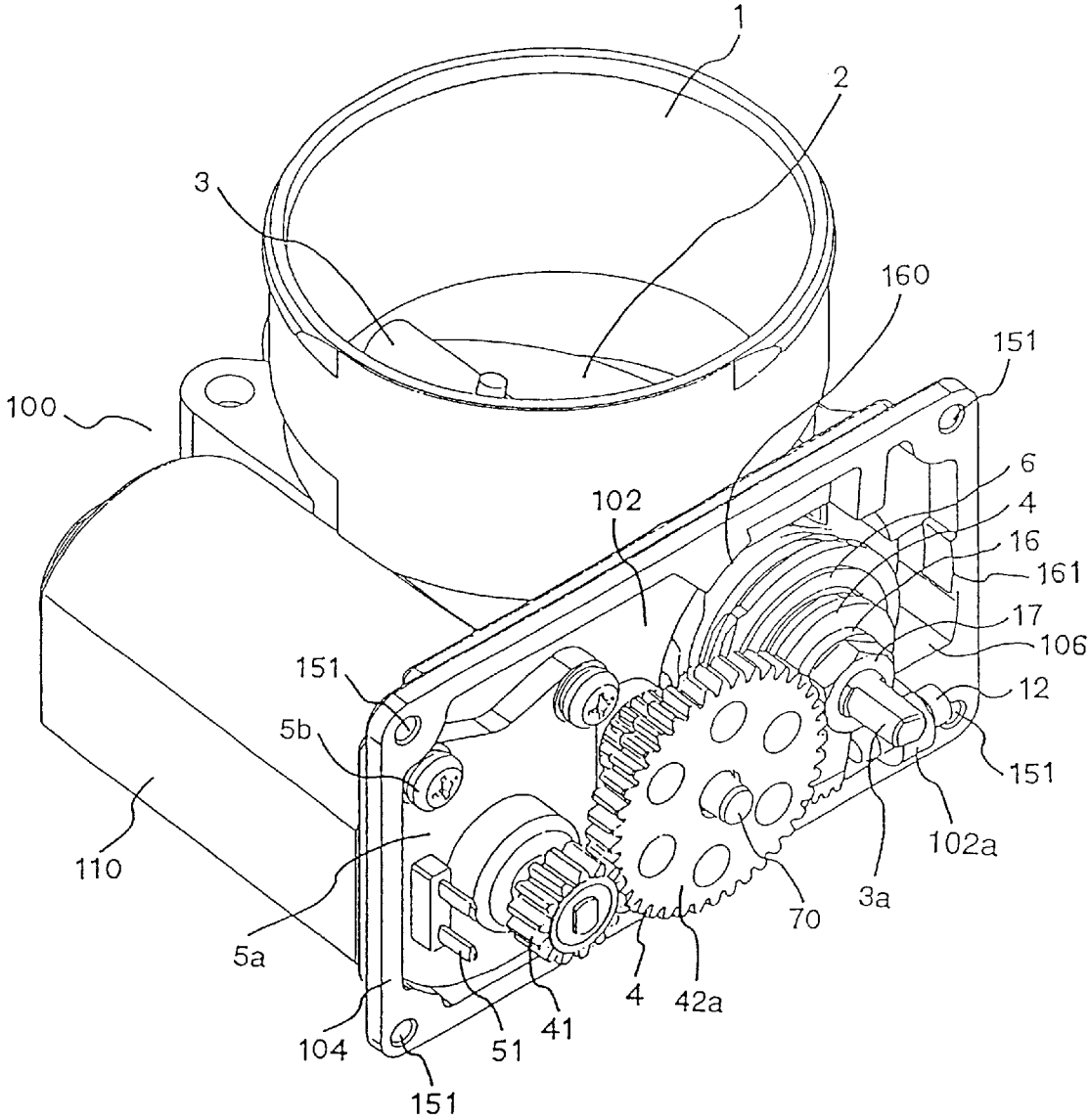
FIG. 7 is a perspective view showing the throttle device with the gear cover removed.
Figure 16:
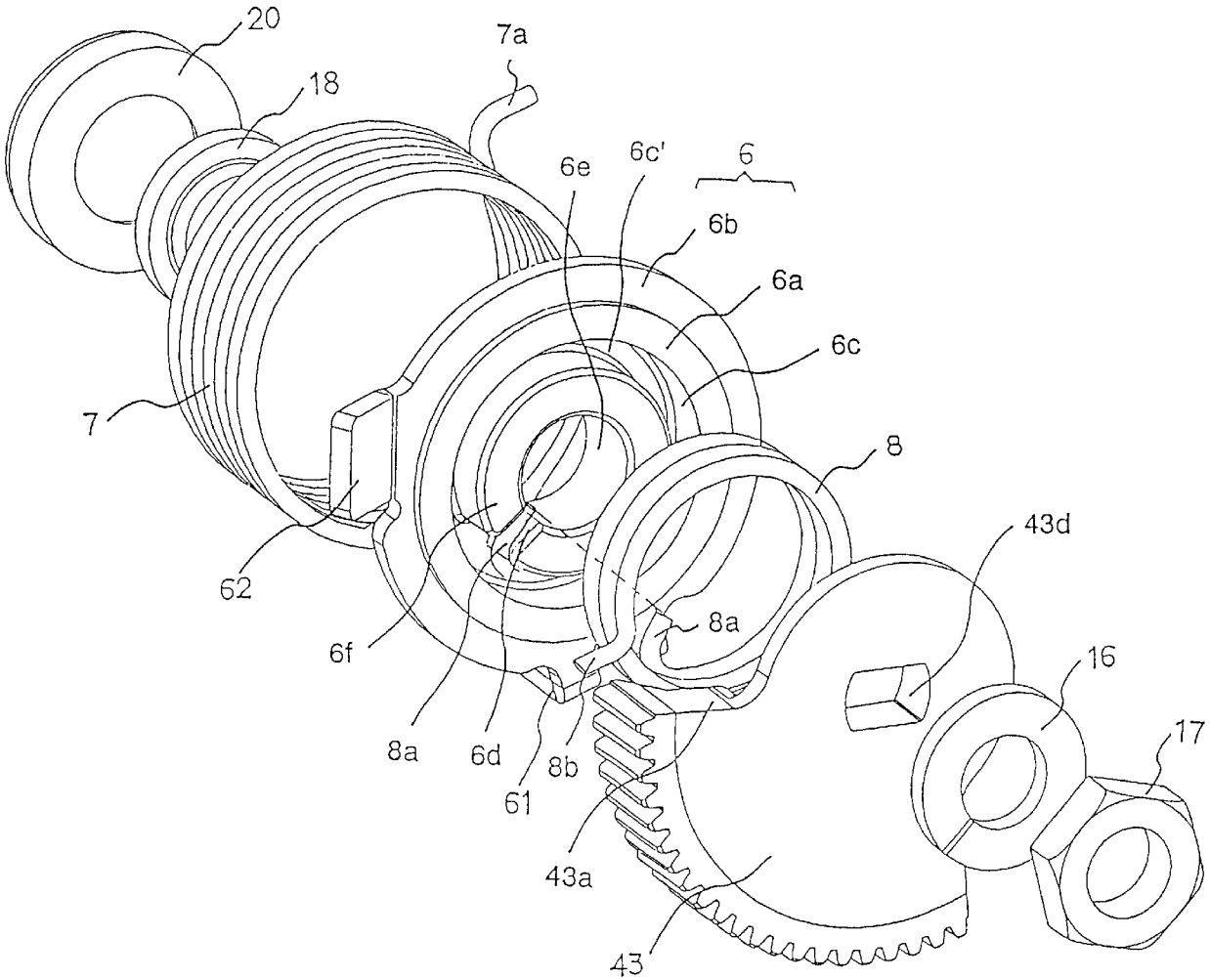
FIG. 16 is an exploded perspective view, partly enlarged, of the throttle device shown in FIG. 15.
Figure 17:
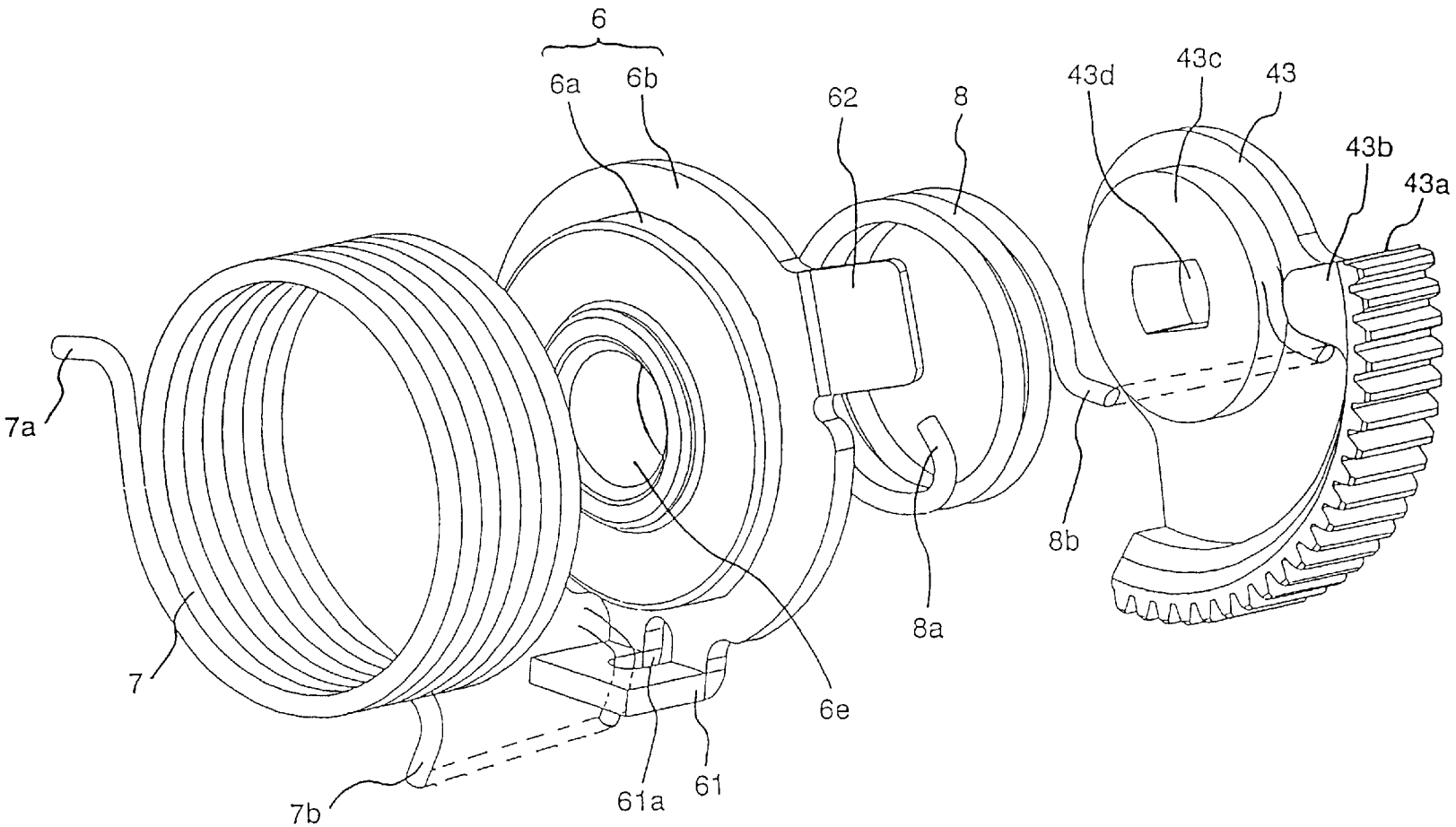
FIG. 17 is an exploded perspective view showing the component of FIG. 16 viewed from a different direction.

In FIG. 1, the projecting portions 61 and 62 of the default lever and the spring retaining portion 43*b* formed on the throttle gear 43 have been exaggerated for purposes of illustration. In actual use, the springs 7 and 8 are compressed in an axial direction to a short length, and therefore these projecting portions are formed short correspondingly to the compressed spring length as shown in the exploded views of FIGS. 16 and 17. Furthermore, in FIG. 1, the spring retaining portion 43*b* is provided on one end of the side opposite to the gear side of the throttle gear 43 and to allow easy view to the spring retaining portion 43*b*. Actually, however, the spring retaining portion 43*b* is invisibly provided in the inside (back side) of the throttle gear 43 as shown in FIG. 17. The retaining structure for retaining one end 7*b* of the return spring 7 and the retaining structure for retaining one end 8*a* of the default spring 8 shown in FIG. 1 are both simplified ones; actually, however, these retaining structures are as shown in FIG. 7 and FIG. 6. Details of the return spring 7 and the default spring 8 will be described later on.

The full-closed stopper 12 is for defining the mechanical full-closed position of the throttle valve 2. As the throttle valve 2 is turned towards closing to the mechanically full-closed position, one end of the stopper retaining element (here the throttle gear 43 serves as this stopper retaining element) fixed on the throttle valve shaft 3 contacts the stopper 12, thereby checking the throttle valve 2 from closing further.

The default opening setting stopper (sometimes referred to as the default stopper) 11 functions to hold the amount of opening of the throttle valve 2 at a specific initial opening (the default opening) which is wider than the mechanically full-closed position and the electrically full-closed position (the minimum opening for control) when the ignition switch is in off position (when the electric actuator 5 is off).

Figure 8:
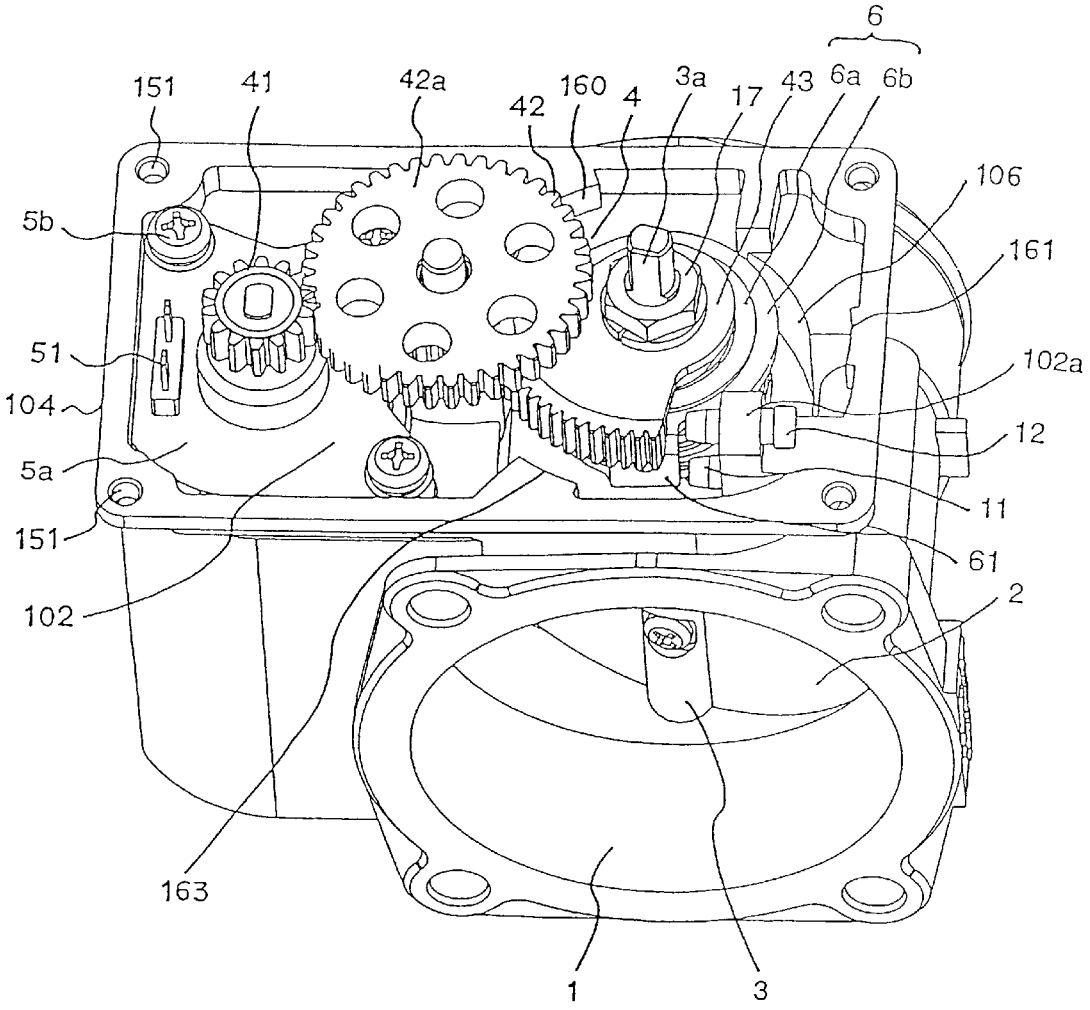
FIG. 8 is a perspective view showing the throttle device at the angle of view changed.

The spring retaining portion 61 formed on the default lever 6 contacts the default stopper 11 when the throttle valve 2 is at the default opening, and functions also as a stopper contact element which prevents the default lever 6 from further turning beyond this stopped position towards decreasing the amount of opening (towards closing). The full-closed stopper 12 and the default stopper 11 is comprised of an adjustable screw (an adjusting screw) provided on the throttle body 100. Actually, as shown in FIG. 8 and FIG. 12, these stoppers 11 and 12 are disposed parallelly or nearly parallelly in close positions where position adjustments can be made in the same direction.

Figure 2A:
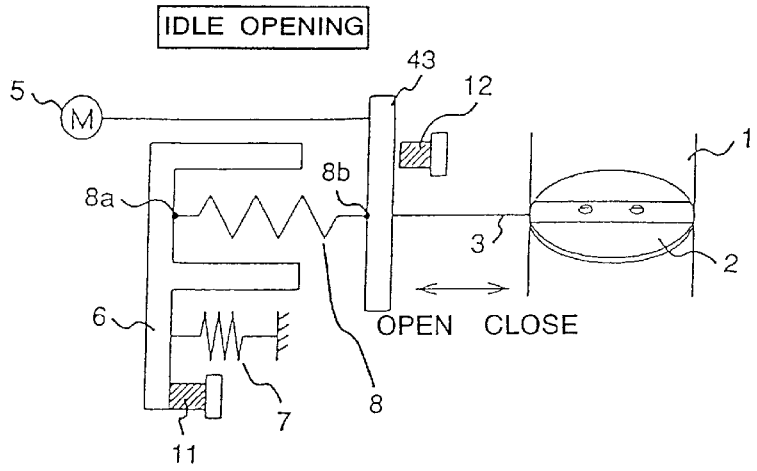
FIGS. 2A–2C are explanatory views equivalently showing the principle of operation of the electronically controlled throttle device of FIG. 1.
Figure 2B:
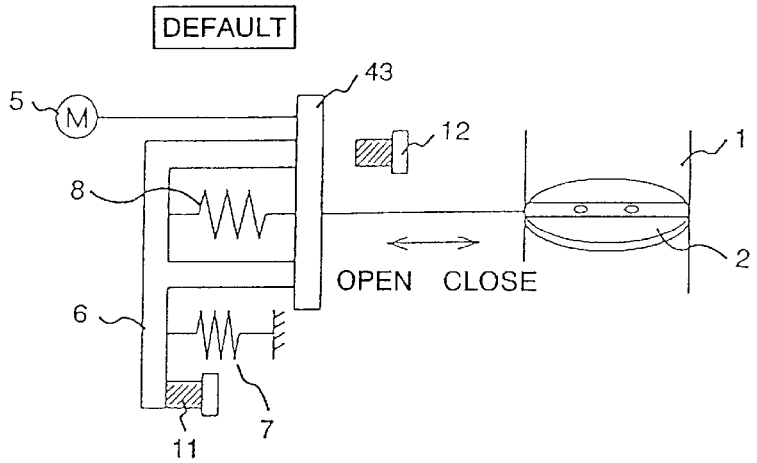
Figure 2C:
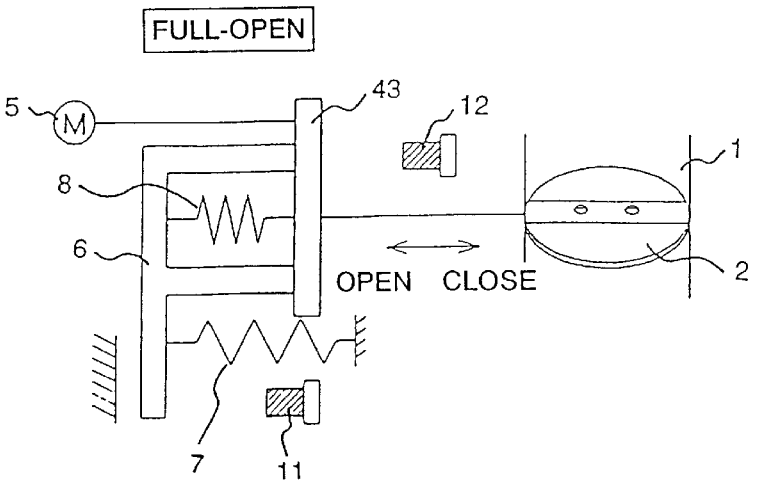

The throttle gear 43 and the default lever 6 have the following settings. When pulled in the direction of rotation through the spring 8, the throttle gear 43 and the default lever 6 can turn together in an engaged state against the force of the return spring 7 within the range of opening over the default opening as shown in FIG. 2C. Also, within the range of opening less than the default opening, the default lever 6 is checked from moving by means of the default stopper 11; and only the throttle gear 43 is rotatable together with the throttle valve shaft 3 against the force of the default spring 8 as shown in FIG. 2A.

When the ignition switch is in its off position, the default lever 6 has been pushed back by the force of the return spring 7 until it is in contact with the default stopper 11. Also the throttle gear 43 has been pushed by the force of the return spring 7 through the projecting portion 62 of the default lever 6; in this state the throttle valve 2 is open to a position corresponding to the default opening as shown in FIG. 2B. In this state, the throttle gear (the stopper retaining element) 43 and the full-closed stopper 12 are kept at a specific spacing.

As the throttle valve shaft 3 is turned from this state towards opening through the motor 5 and the gear mechanism 4, the default lever 6 turns together with the throttle gear 43 through the engagement side 43*a* and the projecting portion 62, and the throttle valve 2 turns to open to a position in which the turning torque of the throttle gear 4 and the force of the return spring 7 are balanced.

Reversely, when the throttle valve shaft 3 is turned towards closing by a decreased driving torque of the motor 5 through the motor 5 and the gear mechanism 4, the default lever 6 (the projecting portion 61) follows the rotation of the throttle gear 43 and the throttle valve shaft 3 until contacting the default stopper 11. Upon contacting the default stopper 11, the default lever 6 is checked from turning towards closing to the default opening or less. At or under the default opening (e.g., from the default opening to the electrically full-closed position for control), when the throttle valve shaft 3 is driven by a power from the motor 5, only the throttle gear 43 and the throttle valve shaft 3 are disengaged from the default lever 6, thus operating against the force of the default spring 8. The throttle gear 43 is driven, only when checking a reference point for control, by the motor 5 until contacting the full-closed stopper 12 which defines the mechanically full-closed position of the throttle valve. In normal electric control, the throttle gear 43 does not contact the full-closed stopper 12.

According to the default system, the return spring 7 works when the throttle valve is open over the default opening because of the presence of the default stopper 11. Therefore, the throttle device has the advantage that, at or under the default opening, the force of the default spring 8 can be set without being affected by the force of the return spring 7, thereby enabling to reduce the default spring load, to decrease a torque demanded by the electric actuator, and to reduce an electric load to the engine.

In the present embodiment, both the return spring 7 and the default spring 8 are torsion coil springs; the return spring 7 being made larger in diameter than the default spring 8, so that these springs 7 and 8 held around the throttle valve shaft 3 are disposed between the throttle gear 43 and the wall section of the throttle body 100.

Figure 4:
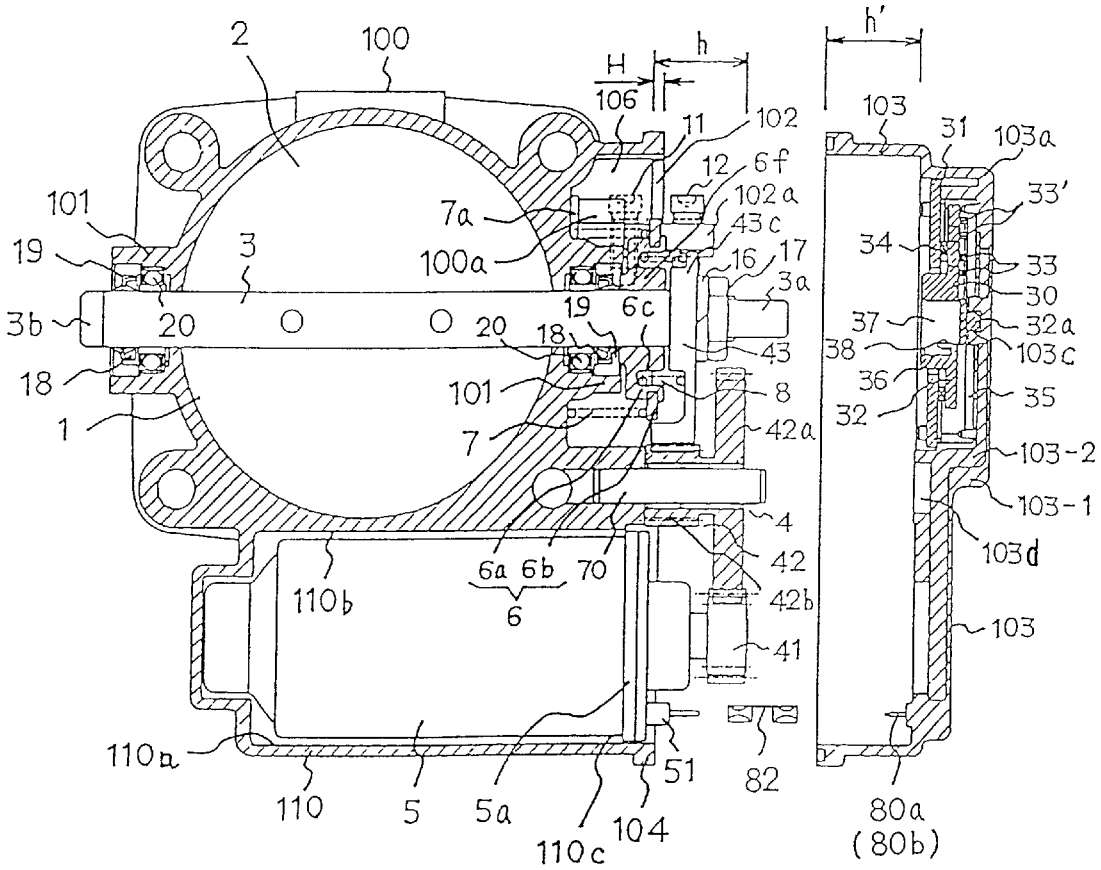
FIG. 4 is a view showing the throttle device taken in the same sectional position as FIG. 3 with the gear cover fitted with the throttle sensor removed.
Figure 5:
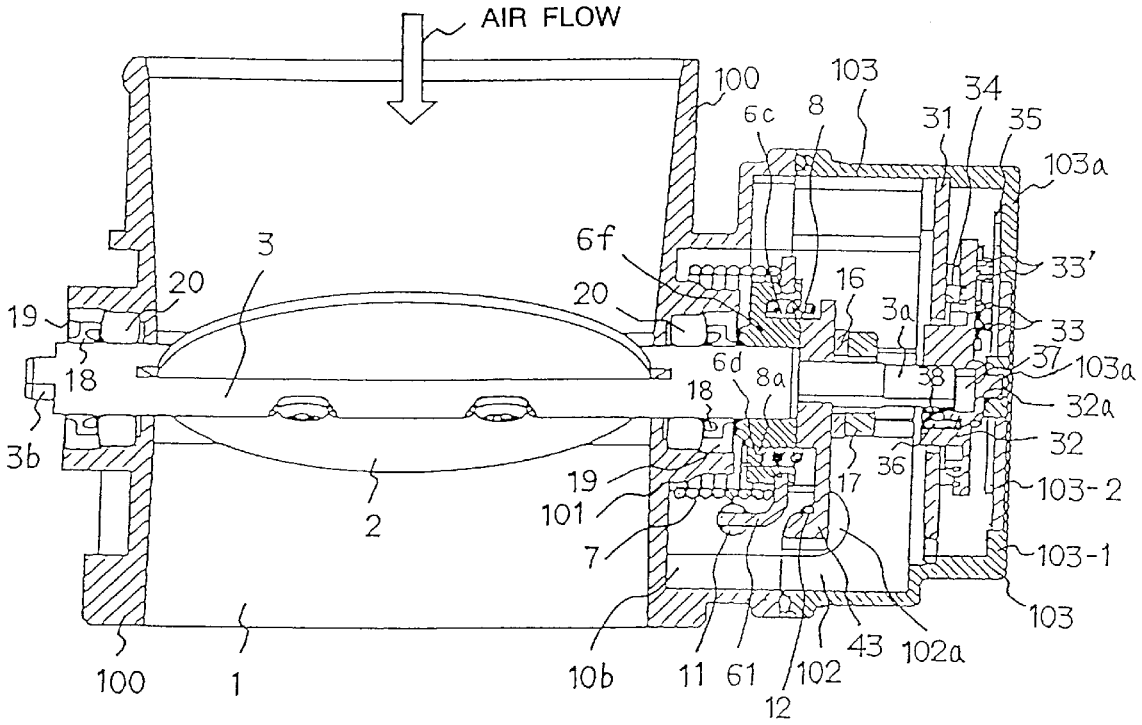
FIG. 5 is a sectional view of the throttle device of FIG. 3 taken in the axial direction of the intake air passage.

The return spring 7 and the default spring 8 are disposed oppositely in the direction of the throttle valve shaft across the default lever 6. In an actual device, these springs are mounted compressed in the axial direction as shown in FIGS. 3 to 5. Both sides of the default lever 6 serve to receive the return spring 7 and the default spring 8, retaining the ends 7*b* and 8*a* of these springs. And a larger-diameter coil spring (the return spring 7 in the present embodiment) has a greater compressive stress F than the compressive stress f of the small-diameter coil spring (the default spring 8 in the present embodiment). The compressive stresses are set as follows.

The default lever 6, being free- or loose-fitted on the throttle valve shaft 3, has a clearance in the fitted portion (between the outer periphery of the throttle valve shaft 3 and the inner periphery of the default lever 6). Therefore, the default lever 6, if held between the return spring 7 and the default spring 8, will loose stability in case the compressive stresses are the same or the coil diameter of either spring is made small to hold the default lever 6 at about the midsection, with the result that the default lever 6 is attached inclined.

The default lever 6, if not properly mounted as stated above, will fail to operate without a hitch, contacting the default stopper 11 at an improper point and accordingly resulting in a defective setting of the default opening. In order to cope with such a problem, the return spring 7 used in the present embodiment is increased in diameter about as large as the flange 6*b* which forms the outside diameter of the default lever 6, and, besides, its compressive stress F is set substantially greater than the compressive stress f of the default spring 8. According to the above-described constitution, the compressive stress F of the return spring 7 acts on the vicinity of the outer periphery (the vicinity of the outside diameter) of the default lever 6; and moreover, because of the relation of F>f, the default lever 6 is pressed unidirectionally (towards the throttle gear 43 side in this case) with a uniform pressure and therefore can be attached in a stabilized state (without tilt), thus enabling to insure smooth default lever operation and a given default opening setting accuracy.

Figure 9:
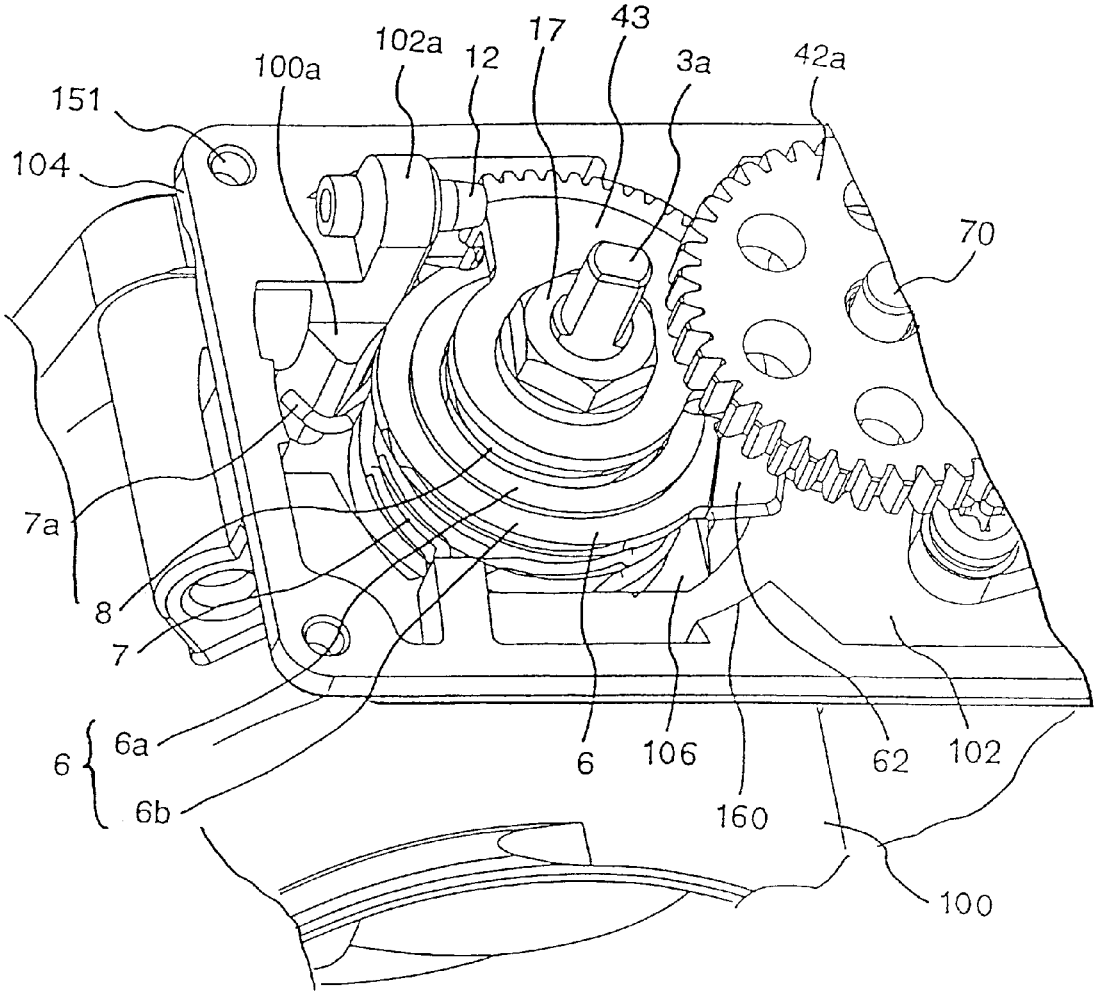
FIG. 9 is a perspective view showing the throttle device at the angle of view changed.
Figure 10:
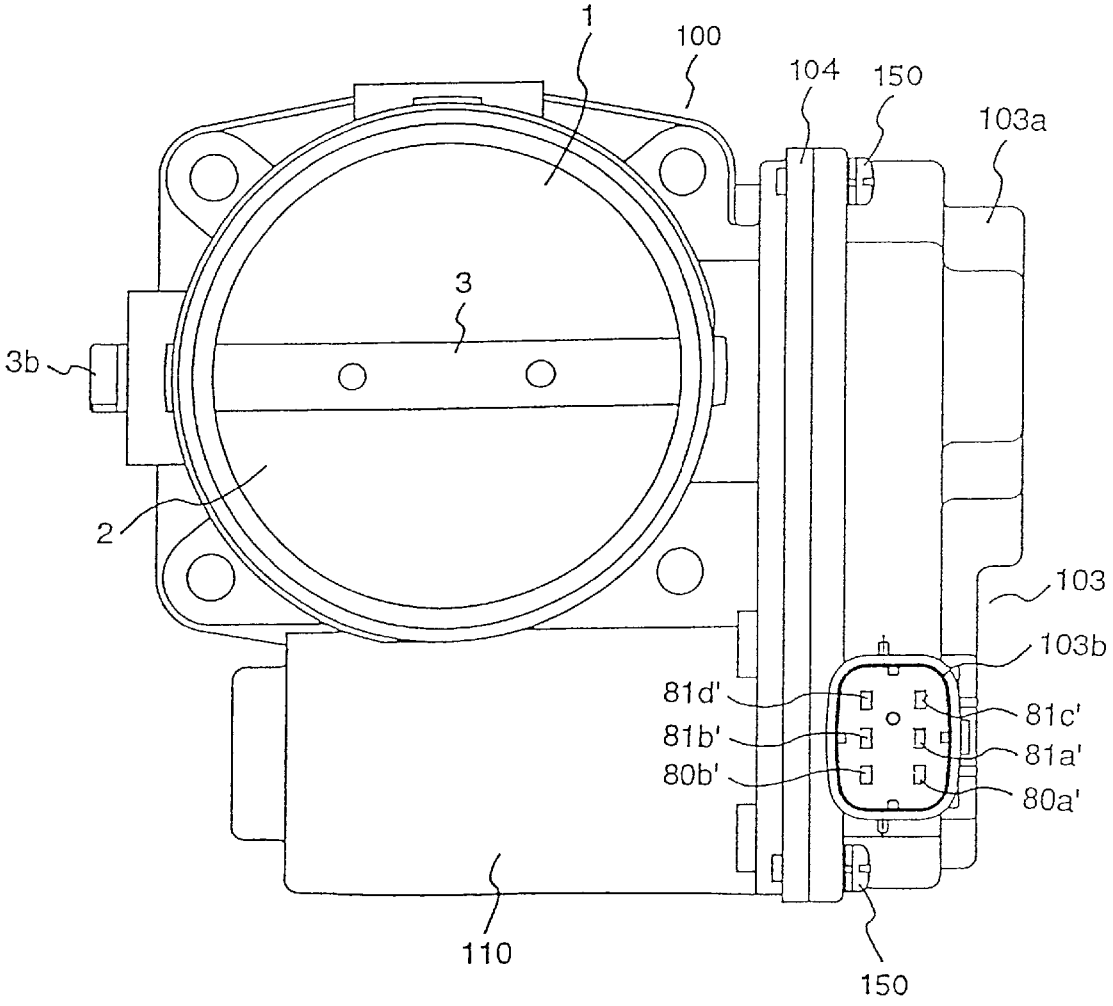
FIG. 10 is a top view of the throttle device.
Figure 11:
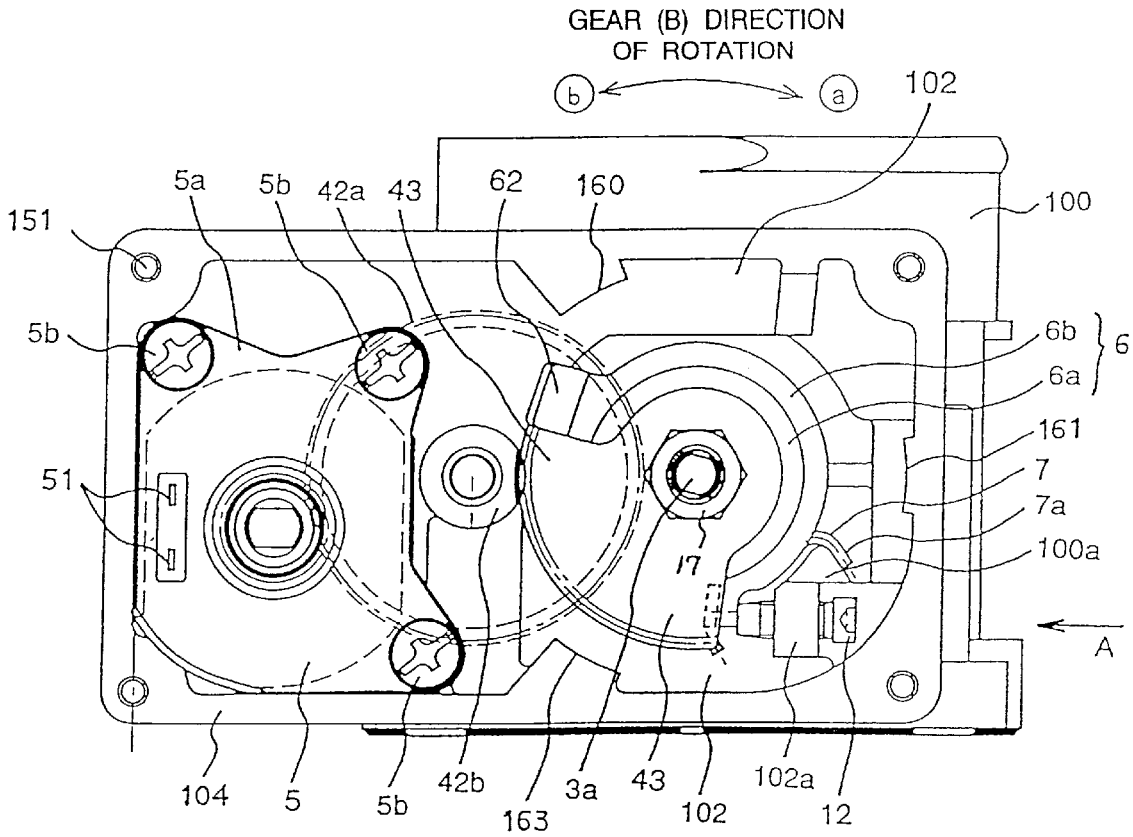
FIG. 11 is an external view of the throttle device with a gear mounting section removed from the gear cover.
Figure 12A:
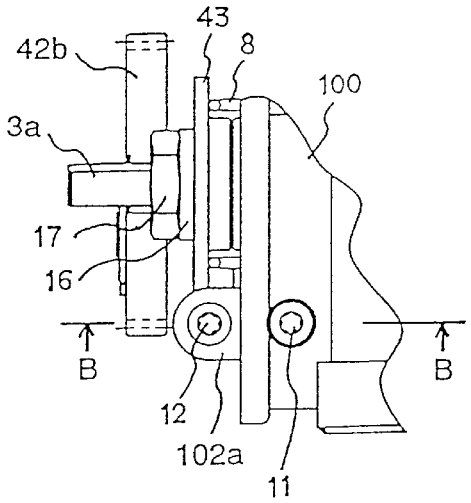
FIG. 12A is a partial view taken in the direction of the arrow A of FIG. 11.
Figure 12B:
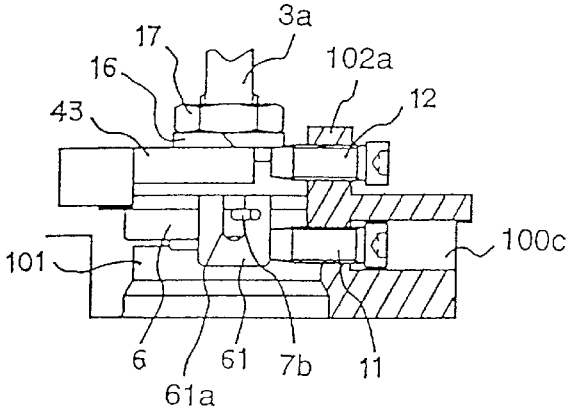
FIG. 12B is a sectional view taken along line B—B of FIG. 12A.
Figure 13:
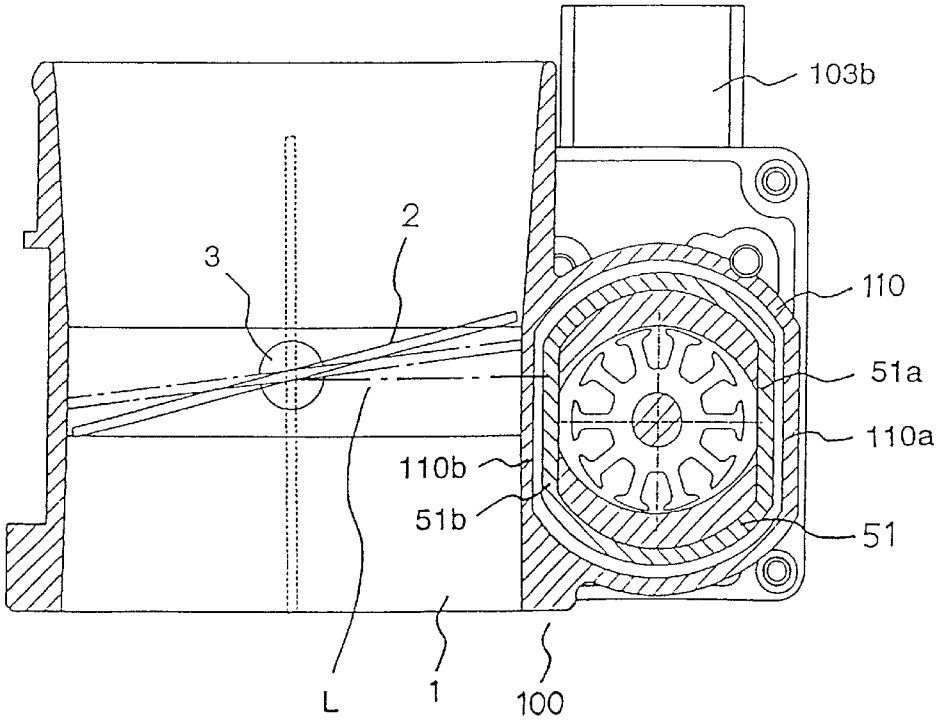
FIG. 13 is a sectional view taken along line C—C of FIG. 6.
Figure 14:
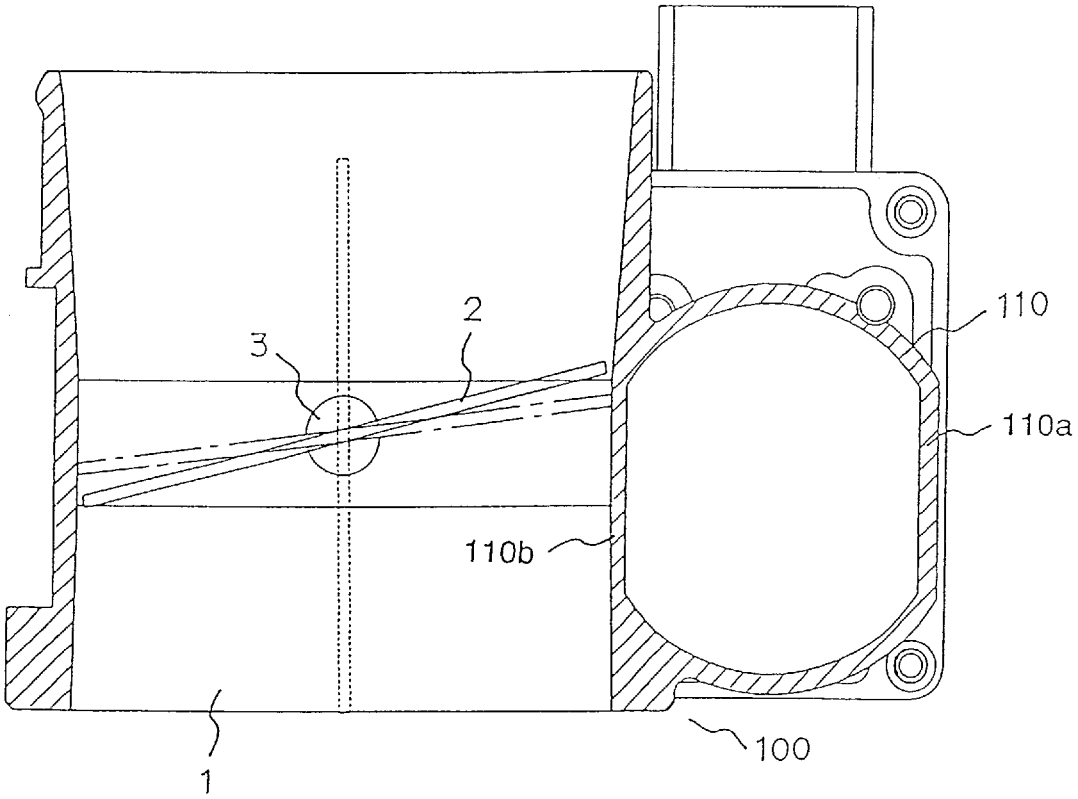
FIG. 14 is a sectional view of the motor casing of FIG. 13 off the motor.
Figure 15:
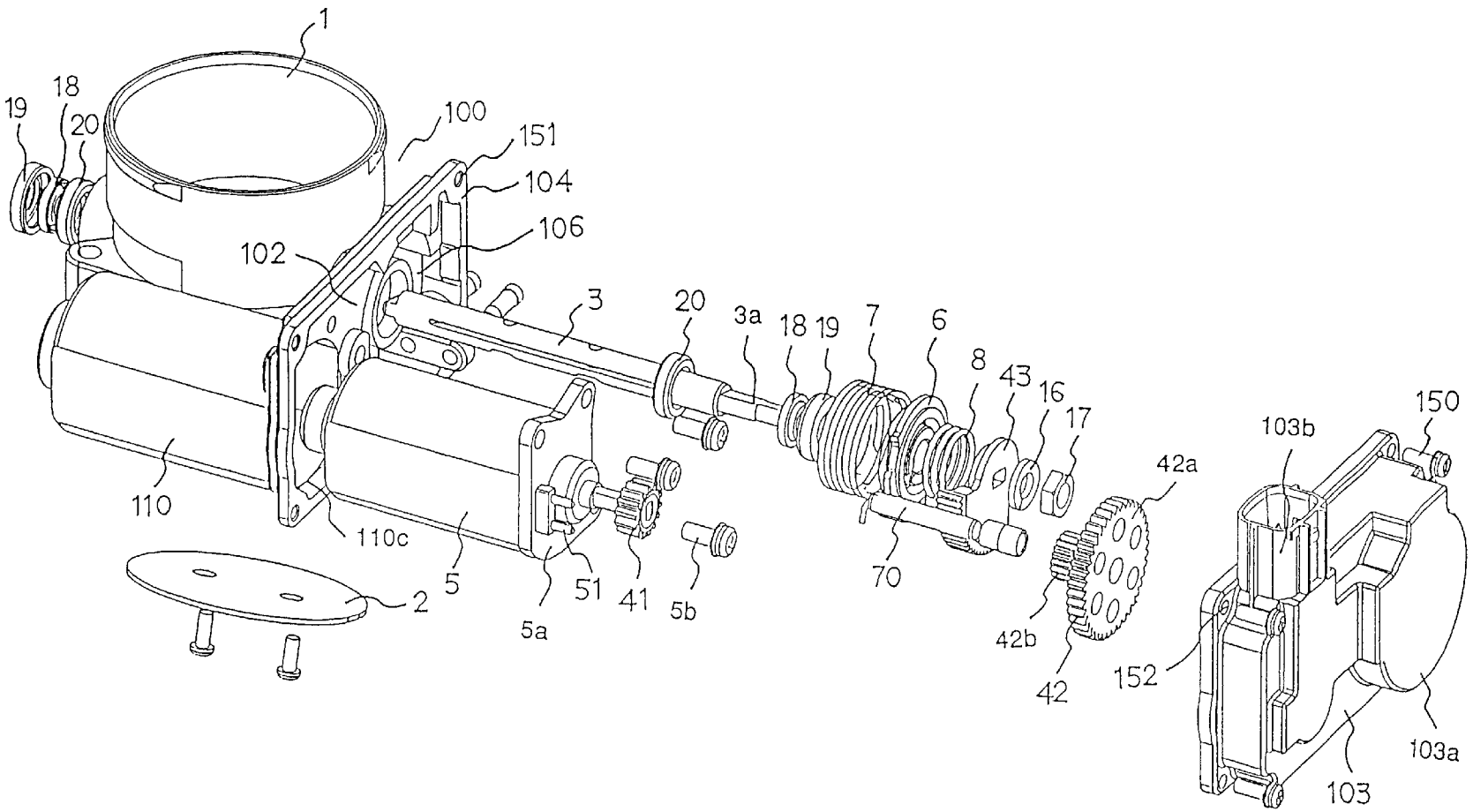
FIG. 15 is an exploded perspective view of the throttle device pertaining to the embodiments.

FIG. 3 is a sectional view of the electronically controlled throttle device pertaining to the present embodiment taken perpendicularly to the axial direction of the intake passage 1; FIG. 4 is a view showing the electronically controlled throttle device of FIG. 3 taken in the same sectional position as FIG. 3 with the gear cover having the throttle sensor removed; FIG. 5 is a sectional view of the electronically controlled throttle device of FIG. 3 taken in the axial direction of the intake air passage 1; FIG. 6 is a perspective view of the electronically controlled throttle device of the present embodiment; FIG. 7 is a perspective view showing the electronically controlled throttle device with the gear cover removed; FIG. 8 and FIG. 9 are perspective views taken at an angle changed; FIG. 10 is a top view of the electronically controlled throttle device; FIG. 11 is an external view of the electronically controlled throttle device with a gear mounting section removed from the gear cover; FIG. 12 is an explanatory view showing the full-closed stopper and the default stopper in mounted state, in which FIG. 12A is a partial view taken in the direction of the arrow A of FIG. 11, while FIG. 12B is a sectional view taken along line B—B of FIG. 12A; FIG. 13 is a sectional view taken along line C—C of FIG. 6, showing a positional relation between the intake air passage of the throttle device and the motor casing; FIG. 14 is a sectional view of the motor casing 110 off the motor; FIG. 15 is an exploded perspective view of the electronically controlled throttle device pertaining to the embodiments; FIG. 16 and FIG. 17 are exploded perspective views, partly enlarged, of the throttle device shown in FIG. 15.

As shown in these drawings, a gear mounting space 102 for the gear mechanism 4 is formed on one side wall of the throttle body 100. The gear mounting space 102 is provided with a partly deep-recessed portion 106, in which has a bearing boss 101 for housing one of bearings 20 of the throttle valve shaft 3. The bearing 20 is sealed by a sealing member 18 supported by a seal holder 19.

The return spring 7 is a torsion coil spring, most of which is disposed around the bearing boss (the annular recess 106), with one end (a fixed end) 7*a* bent outwardly and retained by the spring retaining portion 100*a* provided in the recess 106 in the throttle body side wall as shown in FIGS. 1, 3, 9 and 11 and with the other end 7*b* bent outwardly and retained by a projection 61 provided on the default lever 6 as shown in FIG. 17, thereby applying a spring force to the default lever 6 towards closing the throttle valve. In the present embodiment, one end 7*b* of the return spring 7 is accidentally irremovably retained in a retaining hole 61*a* formed in the projection 61 of the default lever 6 as shown in FIG. 17.

The throttle gear 43, as is clear from FIGS. 3 to 5, and FIGS. 16 and 17, has a throttle valve shaft insertion boss 43*c* only on one side which receives one end of the default spring 8. On the other hand, the default lever 6 also is provided with a throttle valve shaft insertion boss 6*f* oppositely to the boss 43*c*. Around these bosses 43*c* and 6*f*, the default spring 8 is arranged.

The default spring 8 of this example is also a torsion coil spring, one end 8*a* of which is bent inwardly as shown in FIG. 16 and retained in a slot 6*d* formed in the boss 6*f* of the default lever 6, while the other end 8*b* is bent towards the outside diameter side and retained by the retaining projection 43*b* provided inside of the throttle gear 43 as shown in FIG. 17.

The throttle valve shaft insertion hole 43*d* provided in the boss 43*c* of the throttle gear 43 has a flat surface at least on one side. In the present embodiment, the insertion hole 43*d* is a square or nearly square hole having two parallel flat surfaces. One end 3*a* of the throttle valve shaft 3 has a section similar in shape to the throttle valve shaft insertion hole 43*d* and the throttle gear 43 is pressed in for fixedly mounting on one end of the throttle valve shaft 3.

The default lever 6 includes a dish-type plastic section 6*a* made of a reinforced plastics material and a metal flange section 6*b* provided on the peripheral edge as shown in FIGS. 3 to 5, 16 and 17. The inner edge of the flange section 6*b* is embedded in the outer periphery of the plastic section 6*a* by molding the plastic section 6*a*, thereby unifying the plastic section 6*a* with the flange section 6*b*. Projections 61 and 62 are provided by thus molding the flange section 6*b*. The default lever 6 may all be molded of a resin or a metal plate.

In the present embodiment, the default lever 6 receives at its flange section 6*b* the compressive stress F of the return spring 7. Also, as shown in FIG. 16, the plastic section 6*a* has a boss 6*f* around a through hole 6*e* in which the throttle valve shaft is inserted. Around the boss 6*f*, there is provided an annular groove 6C in which one end of the default spring 8 is fitted. The bottom surface of the groove 6C receives the compressive stress f of the default spring 8, establishing the previously stated relation of F>f.

The throttle gear 43 fixed on the throttle valve shaft 3 and the default lever (the engagement element for setting the default opening) 6 are pulled in the-direction of rotation towards mutual engagement through the default spring 8.

The throttle valve shaft 3 is provided with an external screw thread on one end portion. After mounting the default lever 6, the default spring 8, and the throttle gear 43, the nut 17 is tightened through the spring washer 16. In the present embodiment, the return spring 7 and the default spring 8 whose compressive stresses are in the relation of F>f are compressed by the pressure of the throttle gear 43. It should be noticed that the throttle gear 43 which is mounted by pressing in may be fixed by tightening the nut 17. In this case, the return spring 7 and the default spring 8 are compressed by a tightening torque used in tightening the nut.

The return spring 7 and the default spring 8 are coated with for instance a tetrafluoroethylene resin coating for decreasing friction coefficient for purposes of reducing friction. The primary purpose of this coating is to reduce friction with a mating portion (a portion like the member and boss which contact the springs 7 and 8 during torsional operation), thus enabling smooth throttle valve operation by the power from the motor and reduction of motor power consumption during operation.

In the gear mounting space 102 provided over the side wall surface of the throttle body 100, a rim 104 is formed unitarily with the throttle body 100. The rim 104 serves as a frame for mounting the gear cover. The frame 104 is formed lower than the mounting height of the reduction gear mechanism 4 with reference to the bottom surface of the gear mounting space 102 as shown in FIG. 4(height H of the frame 104<height h of the reduction gear mechanism 4). The interior volume of the gear cover 103 in the direction of depth is increased by increasing the height h' of the side wall 105 of the gear cover 103 by the thus decreased portion of height of the frame (the rim 104), thereby enabling covering the reduction gear mechanism 4 with the gear cover 103. Because of adoption of the constitution described above, it has become unnecessary to provide the throttle body side wall with the gear case having an enclosing wall which is higher than the mounting height of the gear mechanism; and the decreased amount of the enclosing wall of the gear case can be compensated for by the synthetic resin gear cover 103. Consequently, the mold-cast metal throttle body 100 can not only be downsized but reduced in weight.

As a result of the decrease in height of the gear cover mounting frame 104, in the present embodiment, the mounting height of the pinion 41, intermediate gear 42*a* and throttle gear 43 of the reduction gear 4 has been increased over the frame 104. Therefore, the throttle gear 43 is protruded out over the frame 104, and can not be stopped by the full-closed stopper 12 provided on the frame. Therefore, a projection 102*a* for mounting the full-closed stopper 12 in a position where the gearing is covered with the gear cover 103 is set unitarily with the throttle body. The projection 102*a* is formed higher than the frame 104; and on this projection 102*a*, the full-closed stopper 12 is arranged at the mounting height of the throttle gear 43.

Since the default lever 6 is disposed at a lower level than the frame 4, the default stopper 11 is arranged parallelly (and nearly parallelly) with the full-closed stopper 12 through a hole 100*c* made in the side wall of the throttle body 100 as shown in FIG. 12.

In the motor used as the electric actuator, there are formed two opposite flat surfaces 51*a* and 51*b* on a yoke 51 forming the motor housing as shown in FIG. 13. The motor casing 110 housing the motor has opposite flat inner surfaces 110*a* and 110*b* formed to the contour of the motor housing, and is so disposed on the side wall of the throttle body 100 as to intersect a line orthogonal with the throttle valve shaft 3. The axial direction of the motor casing 110 is the same as that of the throttle valve shaft 3.

Because of the use of the motor 5 having such flat surfaces, the motor casing 110 formed unitarily with the throttle body 100 is also provided with a flat surface, doing much towards the downsizing of the throttle body. Furthermore, in the present embodiment, the entire or most part of one inner surface 10*b* of the opposite flat surfaces of the motor casing 110 constitutes the outside wall surface of the intake air passage 1 located downstream of the idle opening position for controlling the throttle valve 3. Here, as one example thereof, the entire or most part of the flat inner surface 110*b* constitutes the outside wall surface of the intake passage located downstream of the electrically full-closed position for controlling the throttle valve. Furthermore, the flat inner surface 110*b* is so formed as to be recessed deeper than the outside wall surface of the surrounding intake air passage. As shown in FIG. 14, the wall on the inner surface 110*b* side of the motor casing 110 adjacent to the intake passage 1 is decreased in thickness, to thereby bring the inner surface 110*b* of the motor casing closer to the intake passage side.

The motor insertion port 110*c* of the motor casing 110 opens on the gear mounting space 102 side; a motor bracket 5*a* is attached by screws 5*b* at three positions around the motor insertion port 110*c* as shown in FIG. 11, thus forming a motor positioning line conforming to the contour of the motor bracket 5*a*.

Power source terminals (motor terminals) 51 of the motor 5 are led to a space covered by the gear cover 103 through the motor bracket 5*a* as shown in FIGS. 7 and 8, and connected to terminals 80*a*, 80*b* provided on the gear cover 10 through a metal connector 82.

In the present embodiment, a throttle sensor 30 is arranged together with the reduction gear mechanism 4 and the default opening setting mechanism (the default lever 6, default spring 8, and stopper 11) on one surface side of the side wall of the throttle body 100.

The throttle sensor 30 is for detecting the amount of opening of the throttle valve (the throttle position). In the present embodiment, as shown in FIG. 3 to FIG. 5, all throttle sensor elements that is the complete set of throttle sensor, excepting the throttle valve shaft, are built inside of the gear cover 103 so as to be covered with the sensor cover 31.

One end 3*a* of the throttle valve shaft 3 is extended as far as the position of the rotor 32 of the throttle sensor 30 at the time when the gear cover 103 is mounted, and is so set that, when the gear cover 103 is mounted on the throttle body 100, the one end 3*a* of the throttle valve shaft will fit by itself into a rotor shaft hole 37 exposed to the sensor cover 31.

Next, the constitution of the throttle sensor 30 and the gear cover 103 will be explained by referring to FIGS. 18 to 26 beside FIGS. 3 to 5.

Figure 18:
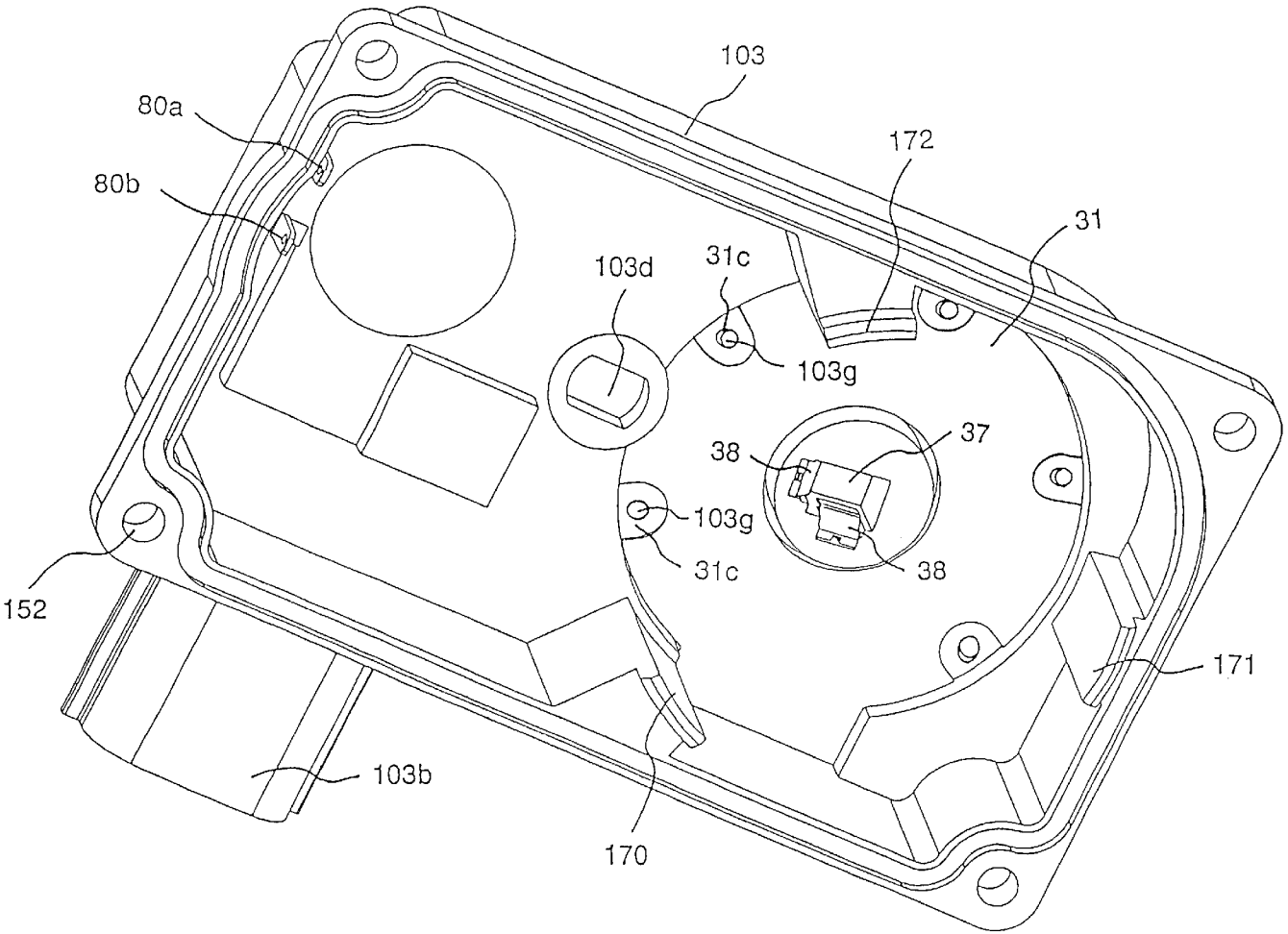
FIG. 18 is a perspective view of the inside of the gear cover used in the embodiments.
Figure 19:
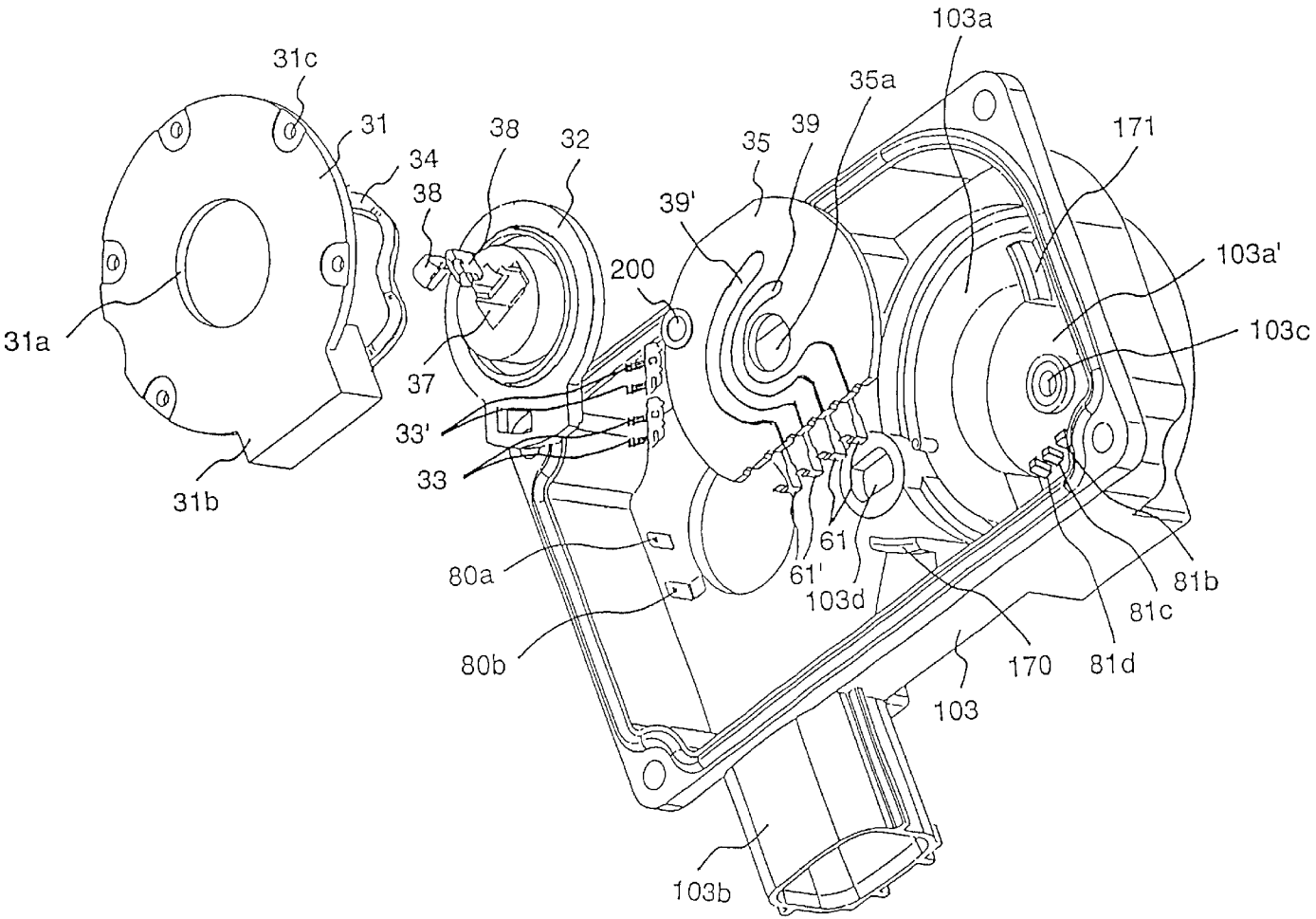
FIG. 19 is an exploded perspective view of a throttle sensor mounted inside the gear cover.
Figure 20:
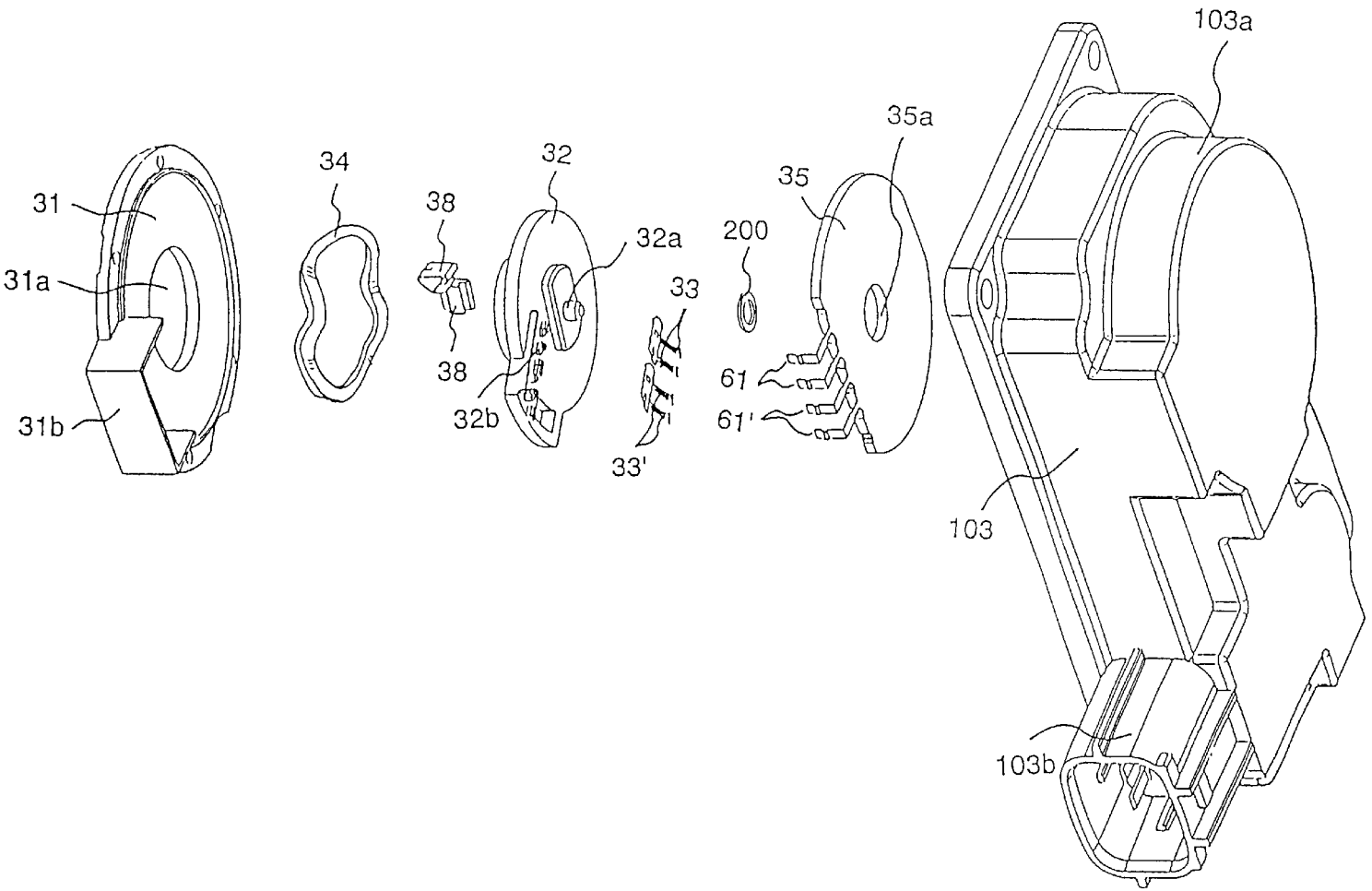
FIG. 20 is an exploded perspective view of the throttle sensor of FIG. 19 viewed from a different direction.
Figure 21:
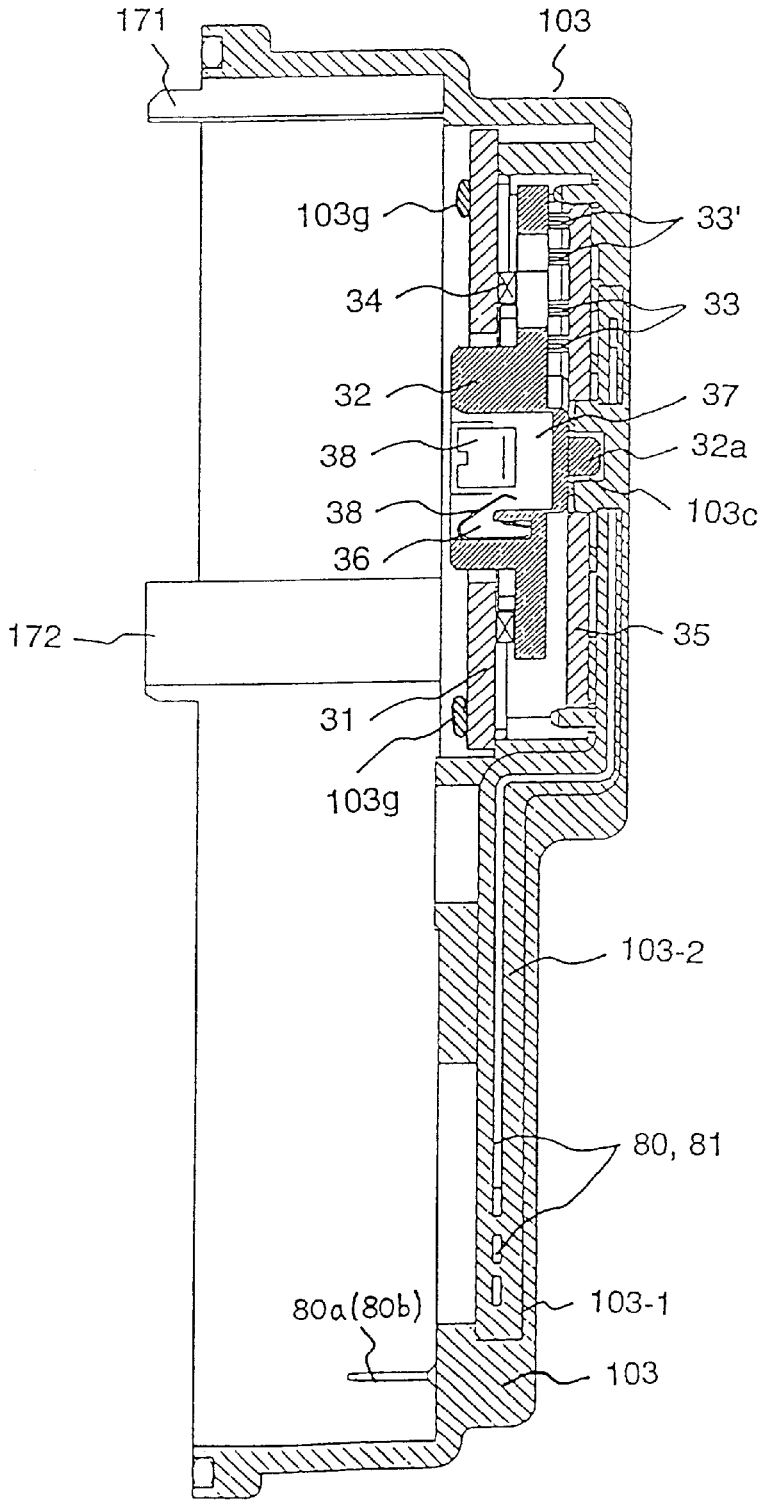
FIG. 21 is a longitudinal sectional view of the gear cover.
Figure 22:
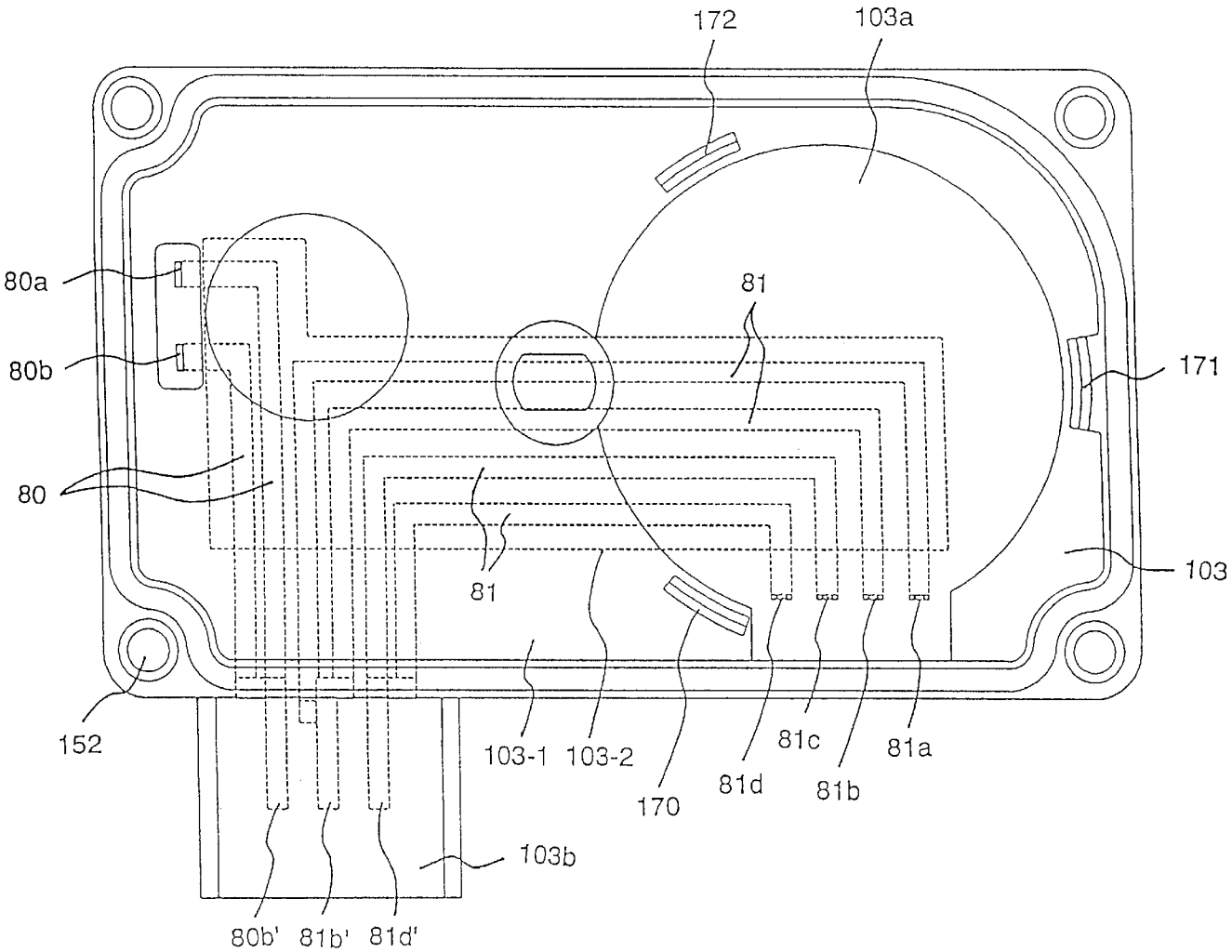
FIG. 22 is a plan view of the gear cover viewed from inside.
Figure 23:
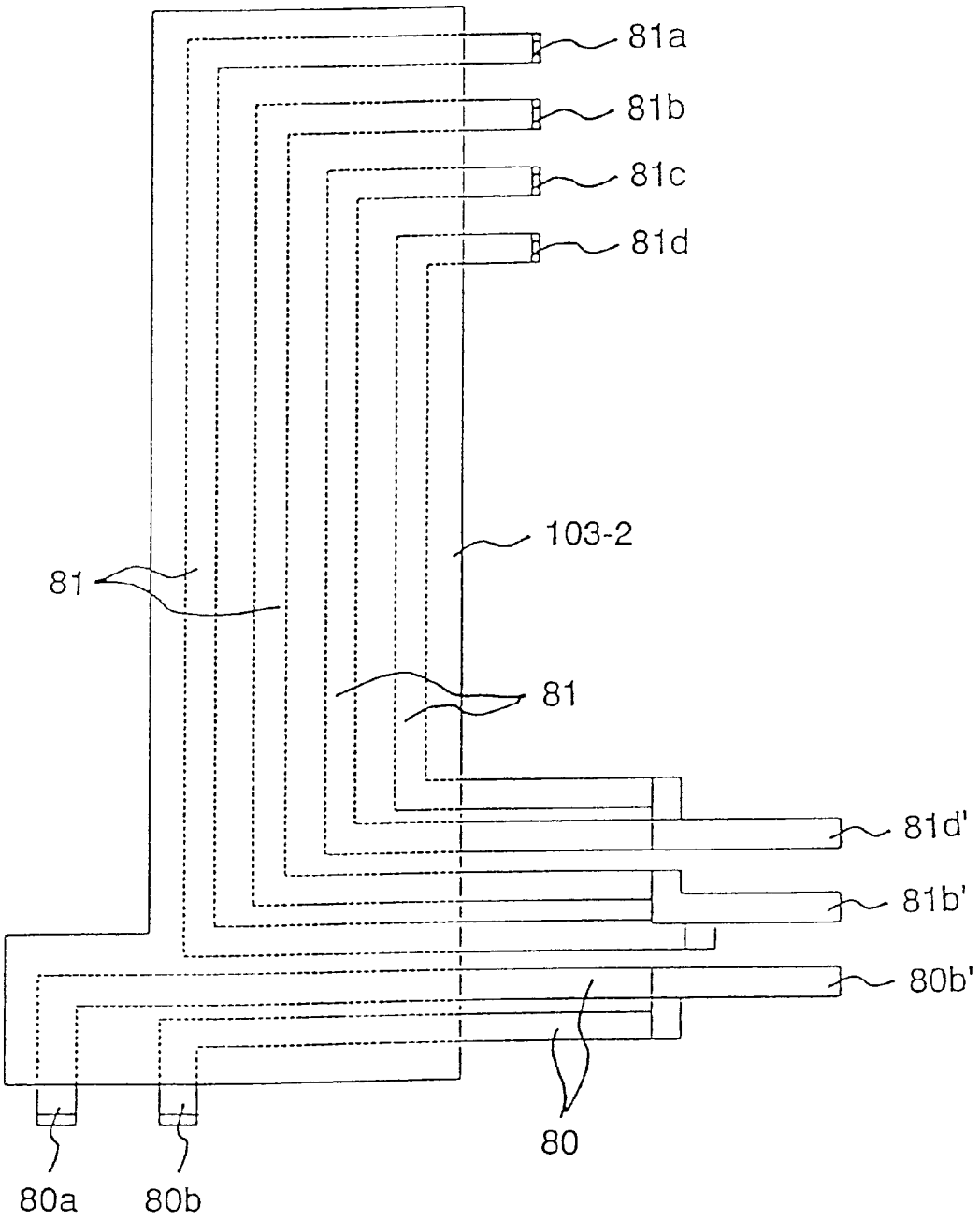
FIG. 23 is a plan view of a terminal clamping plate which is a part of the gear cover.
Figure 24:
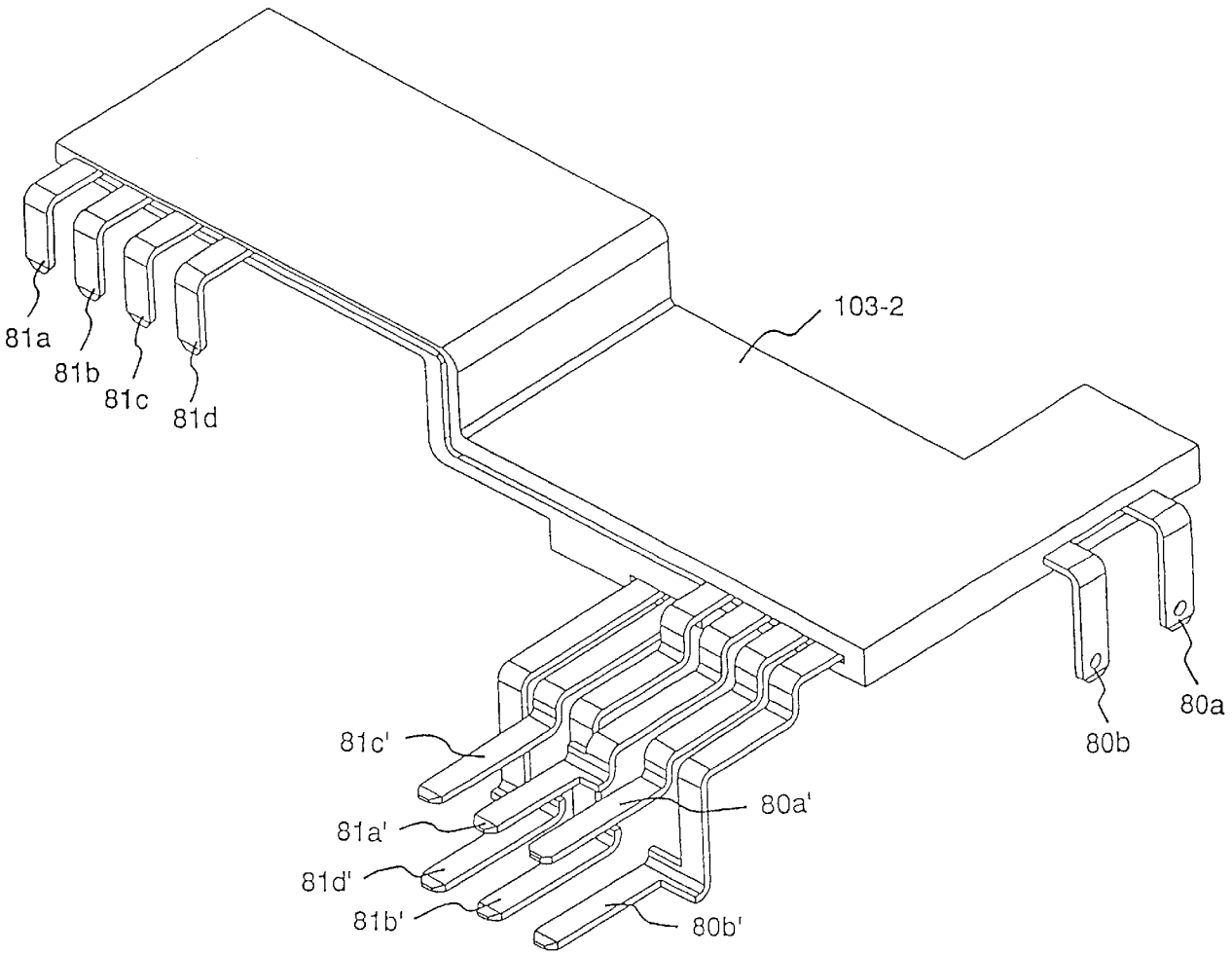
FIG. 24 is a perspective view of the terminal clamping plate.
Figure 25:
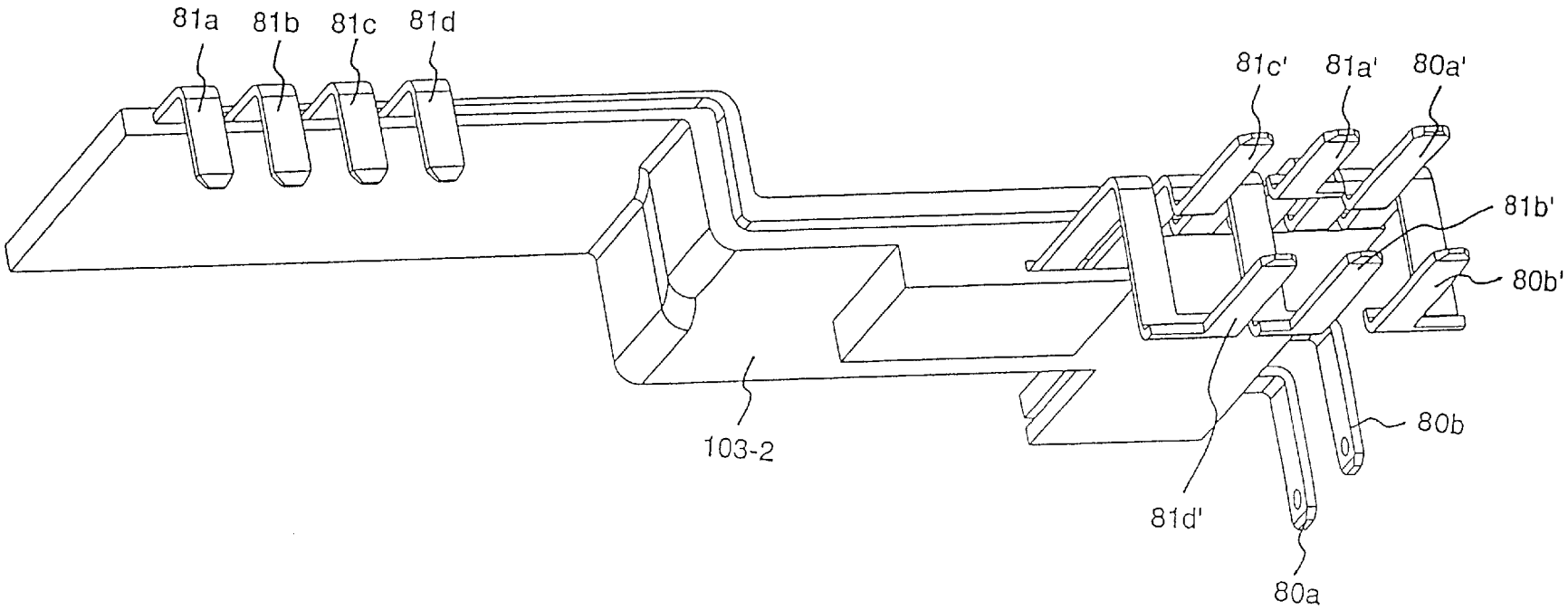
FIG. 25 is a perspective view of the terminal clamping plate viewed from a different direction.
Figure 26:
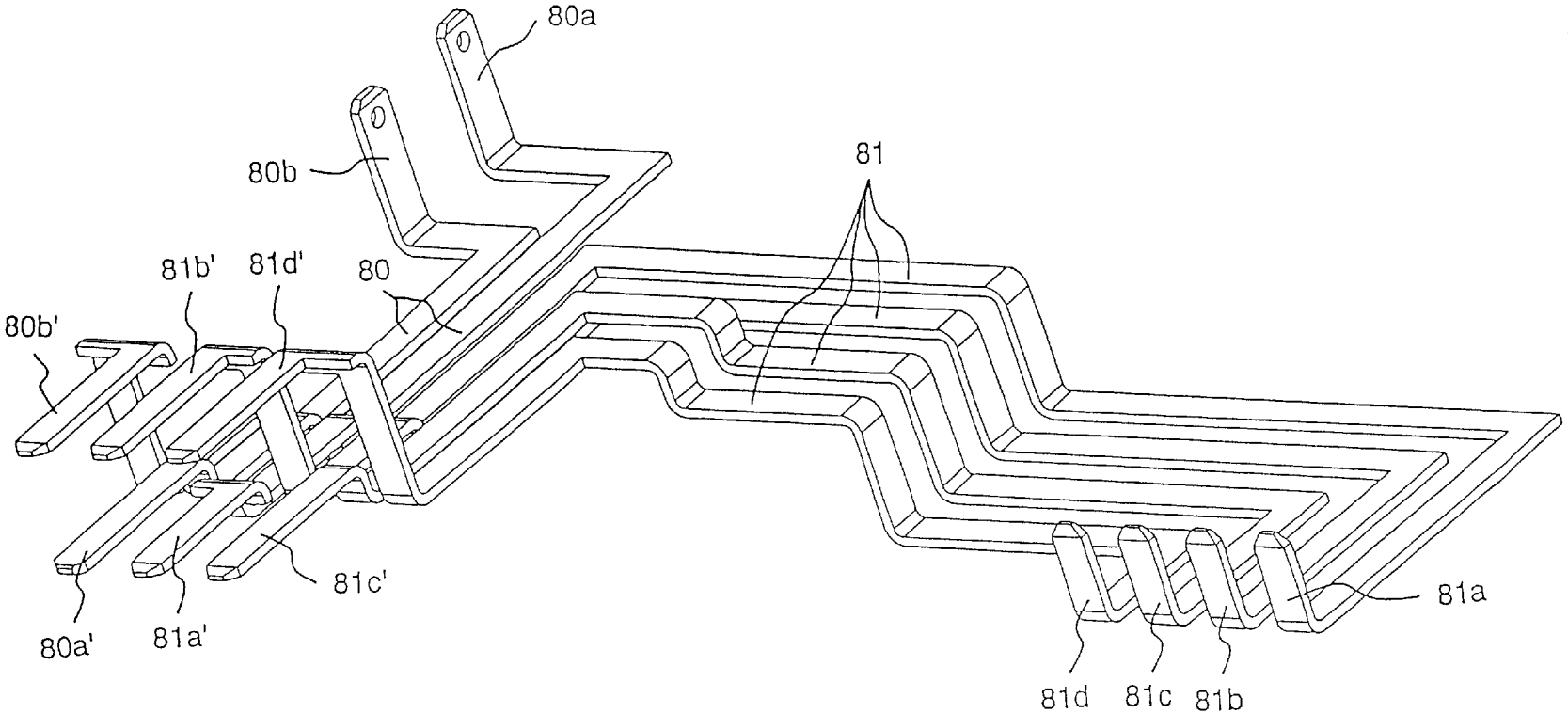
FIG. 26 is a perspective view of a terminal (wiring) secured by resin molding of the fixing plate.

FIG. 18 is a perspective view of the inside of the gear cover 103; FIG. 19 is an exploded perspective view of a throttle sensor 30 mounted inside the gear cover 103; FIG. 20 is an exploded perspective view taken in a different direction; FIG. 21 is a longitudinal sectional view of the gear cover 103; FIG. 22 is a plan view of the gear cover 103 viewed from inside; FIG. 23 is a plan view of a terminal clamping plate 103-2 which is a part of the gear cover 103; FIG. 24 is a perspective view of the terminal clamping plate 103-2; FIG. 25 is a perspective view taken in a different direction; and FIG. 26 is a perspective view of a terminal (wiring).

The gear cover 103 which covers the mounting space 102 of the reduction gear mechanism 4 is formed of a synthetic resin by a molding process, and is formed unitarily with a connector case 103*b* for connection with external power source and signal lines.

The throttle sensor 30 adopted is of a potentiometer system, which, as shown in the exploded perspective views of FIGS. 19 and 20, has resistors 39, 39' formed on one surface, and is comprised of a substrate 35 having terminals 61 and 61' thereof, a rotor 32 fitted with a sliding brush 33 which contacts the resistor wire 39 and a sliding brush 33' which contacts the resistor wire 39', a metal waved washer (which serves as a rotor retaining spring) with repeated waves in the circumferential direction, and a sensor cover (plate) 31 made of a synthetic resin. In the present embodiment, the resistor 39 and the sliding brush 33 form one throttle sensor the resistor 39' and the sliding brush 33' form another throttle sensor, so that, in case one of the throttle sensors has got out of order, the other throttle sensor can function properly in place of the defective throttle sensor. The sliding brushes 33 and 33' fitted on a small projection 32*b* on the rotor 32 are, as shown in FIG. 20, attached to the rotor 32 by thermally heading the small projection 32*b*.

The substrate 35 is bonded on an inside bottom 103*a'* of a throttle sensor housing space (a round recess) 103*a* formed in the inner surface of the gear cover 103. At the center of the inside bottom 103*a'* of the throttle sensor housing space, there is formed a rotor shaft support hole 103*c* in which the projection (the rotating shaft) 32*a* provided at the center of the rotor 32 fits. The projection 32*a* of the rotor 32 is inserted through the hole 35*a* provided at the center of the substrate 35, and fitted in the rotor shaft support hole 103*c* through a washer 200.

The sensor cover 31 has a plurality of mounting holes 31*c* in the peripheral edge. After the substrate 35, the rotor 32, and the waved washer (the rotor retaining spring) 34 are housed in the sensor housing space 103*a*, the mounting holes 31*c* are fitted on small projections 103*g* formed on the gear cover 103 side as shown in FIG. 18 and FIG. 21, and then the small projections 103*g* are thermally headed to secure the sensor cover 31.

The waved washer 34 is interposed between the rotor 32 and the sensor cover 31, and deformed under a compressive force to thereby support the rotor 32 in order to insure smooth rotation without vibration and with a high vibration resistance. On the surface located on the far side of the projection 32*a* of the rotor 32, there is formed a shaft hole (a boss bore) in which one end 3*a* of the throttle valve shaft 3 is fitted. The one end 3*a* of the throttle valve shaft 3 is so formed that two opposite surfaces will be flat. On the other hand, the shaft hole 37 on the rotor side in which the one end 3*a* of the throttle valve shaft fits has two opposite flat surfaces, which conform to the sectional form of the one end 3*a* of the throttle valve shaft so that the throttle valve shaft 3 and the rotor 32 can rotate together.

In the inside wall of the shaft hole 37 of the rotor 32, two grooves 36 are formed at a space of 90 degrees for attaching two bent plate springs (metal fittings) 38 as seen in FIG. 21. The elastic piece of the plate spring 38 is exposed into the shaft hole 37 from the groove 36, in such a manner that the shaft end portion 3*a* of the throttle valve shaft 3 may be pushed into the shaft hole 37, elastically deforming the plate spring 38 (hereinafter sometimes referred to as the fitting spring). Thus the rotor 32 can be mounted on the throttle valve shaft without looseness.

Figure 27:
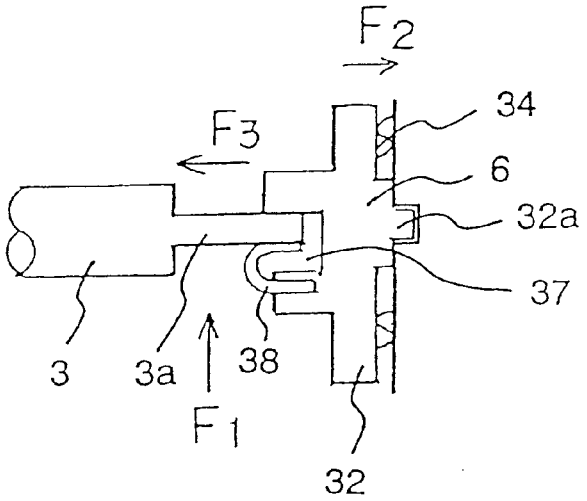
FIG. 27 is an explanatory view showing the operation of the throttle sensor used in the embodiments.
Figure 28:
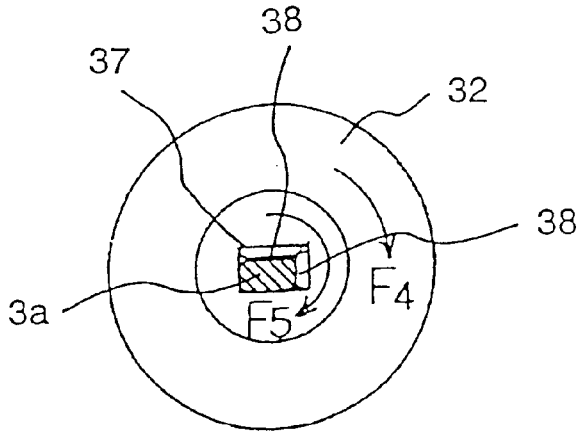
FIG. 28 is an explanatory view showing the operation of the throttle sensor used in the embodiments.

Let F1 be the spring force of the fitting spring 38 which acts on the throttle valve shaft 3, F2 be the spring force of the rotor retaining spring (the waved washer) 34, and F3 be the spring force F1 of the fitting spring 38 multiplied by the coefficient of friction $\sigma 1$ between the throttle valve shaft 3 and the shaft hole 37, and F1 and F2 load are so set as to achieve the relation of ($F3=F1\times\sigma 1$), $F2>F3$ As shown in FIG. 27. Also, let F4 be a turning torque required to turn the rotor 32 (F4=the spring force F2 of the rotor retaining spring 34×the force of friction $\sigma 2$ during rotor rotation) and let F5 be the turning torque against the spring force F1 of the fitting spring 38 as shown in FIG. 28, and the F1 and F2 load are set so as to have the relation of $F5>F4$.

Because of the relation of $F2>F3$, the rotor 32 can be constantly kept in a given position despite of axial vibration of the throttle valve shaft 3, and a chattering of the throttle sensor output can be reduced.

Furthermore, because of the relation of $F5>F4$, it is possible to insure smooth rotation of the rotor 32 in relation to the rotation of the throttle valve shaft 3, and also to improve the responsivity of sensor output.

One end 3*b* of the throttle valve shaft 3 located on the opposite side of the throttle sensor 30 also projects out of the side wall of the throttle body 100 as shown in FIG. 3 to FIG. 5, and FIG. 10. The projecting portion has a flat surface, and is so designed as to be engaged, through this flat surface, with an inspection jig for giving a turning torque to the throttle valve shaft 3 from outside when needed.

Next, the structure of electric wiring formed on the gear cover 103 will be explained with reference to FIGS. 22 to 26.

The gear cover 103 has a plurality (e.g., six in all) of power source conductors 80 and sensor output conductors 81, which are embedded by resin molding. The wiring structure of these conductors 80 and 81 with the resin mold removed will now be described by referring to FIG. 26.

The two power source conductors 80 serves, at one end, as connector terminals 80*a'* and 80*b'* for connection with an external power source, and, at the other end, as connector terminals 80*a* and 80*b* for connection with the motor terminal 51 of the electric actuator 5, which, excepting these terminals, are resin-molded. Here are used four conductors 81 serving as the sensor output lines, of which two conductors are connected at the ends 81*a* and 81*b* with the resistor terminals 61 as show in FIG. 19, of which other two conductors are connected at the ends 81*c* and 81*d* with the resistor terminals 61'. Other terminals 81*a*', 81*b*', 81*c*', and 81*d*' are sensor output connector terminals. Most part of the conductors 80 and 81 excepting these terminals are embedded by resin-molding (gear cover 103.

As shown in FIG. 18 to FIG. 22, the power source terminals 80*a* and 80*b* and the sensor signal output terminals 81*a*, 81*b*, 81*c* and 81*d* are protruded perpendicularly to the inside surface of the gear cover 103. The power source terminals 80*a* and 80*b* are provided against the motor terminal 51 on the throttle body 100 side as shown in FIGS. 3 and 4. The sensor signal output terminals 81*a* to 81*d* are arranged on the inside bottom 103*a*' of the throttle sensor housing section 103*a* correspondingly to the resistor terminals 61 and 61' on the substrate 35 as seen in FIG. 19.

The power source terminals 80*a* and 80*b* are connected with the motor terminal 51 through a joint-type connecting hardware 82. The substrate 35 is fixed in a specific position 103*a*' in the gear cover 103, so that a pair of resistor terminals 61 on the substrate 35 are superposed on the sensor signal output terminals 81*a* and 81*b*, and another pair of resistor terminals 61' are superposed with the sensor signal output terminals 81*c* and 81*d*. The overlapped terminals are mutually welded (by e.g., projection welding). Sensor signals from the sensor signal output terminals 81*a* and 81*b* and sensor signals from the sensor signal output terminals 81*c* and 81*d* are led to the connector terminals 81*a*' and 81*b*', and to 81*c*' and 81*d*' for external connection through each conductor 81.

In the connector section 103*b* are arranged power source connector terminals 80*a*' and 80*b*' and sensor signal output connector terminals 81*a*', 81*b*', 81*c*' and 81*d*', six terminals in all arranged in two rows: three in the upper row and three in the lower row.

The gear cover 103, as shown in FIG. 21, is of a two-stratum structure including partly an inner stratum 103-2 and an outer stratum 103-1. The inner stratum 103-2 is a separately pre-molded plate type, which, with the conductors 80 and 81 excepted terminals, is embedded by molding. The plate 103-2 forming the inner stratum is formed integral with the gear cover body 103-1 forming the outer stratum by molding the gear cover body.

That is, as shown in FIGS. 23 to 25, the plate 103-2 is molded together with the conductors 80 and 81 in advance; thereafter the plate 103-2 is set in a gear cover mold to mold the gear cover body 103-1. The plate 103-2 thus molded is disposed forming the inner stratum section at around the center of the gear cover 103.

The reason why these conductors 80 and 81 with terminals are fixed by molding the plate 103-2 prior to molding the gear cover 103 is that, if the conductors 80 and 81 are embedded in the gear cover 103 from the beginning of molding of the gear cover 103, it is difficult to hold, from the beginning, the conductors 80 and 81 within the mold frame because of a complicated structure of the gear cover, with the result that the conductors 80 and 81 will move at the time of molding and accordingly will not easily be embedded in a proper condition. That is, where the conductors 80 and 81 are embedded in advance at the time of molding of the terminal clamping plate 103-2, the conductor portion exposed out of the plate 103-2 can readily be held, and accordingly it is possible to embed the conductors 80 and 81 with terminals in a proper state in one body with the terminal clamping plate 103-2. Therefore, because the conductors 80 and 81 with terminals have already been fixed, it is possible to prevent defective layout of the conductors 80 and 81 by thus presetting the plate 103-2 in the molding frame for molding the gear cover body 103-1.

The gear cover 103 is attached to the throttle body by inserting and tightening screws 140 into a screw hole 152 provided in the cover 103 and into a screw hole 151provided in the corner of the frame 104. Also since the gear cover 103 needs be mounted in a proper orientation on a throttle body 100, the gear cover and the throttle body can be fitted in only when the projections 170, 171 and 172 provided on the inner surface of the gear cover 103 properly conform respectively to the positioning surfaces 160, 161 and 162 provided on the throttle body 100 side. The gear cover, therefore, can be mounted in a proper direction.

The advantages of the above-described embodiments will be as follows.

(1) In the conventional throttle device the mounting space 102 for the reduction gear mechanism 4 is covered with the gear case formed on the side wall of the throttle body and the gear cover. In the present embodiments, however, most of the mounting space 102 is covered with the gear cover 103 which is used in place of the gear case in the conventional device Therefore, for the throttle body itself, it is unnecessary to mold the gear case of relative large capacity unlike in the conventional throttle device. The light-weight gear cover made of a synthetic resin requires an increased capacity; therefore, it becomes possible to reduce the size and weight of the metal throttle body which is generally formed by die-casting.

(2) Since the default stopper 11 and the full-closed stopper 12 are juxtaposed in the same direction in the throttle body 100 so as to enable adjustment of their positions, screw holes for these stoppers (screws) can be made by drilling in the same direction. Furthermore, the stoppers, being juxtaposed, are adjustable in close positions in the same direction; therefore the adjusting operation can be done with ease.

(3) Even when the gear cover mounting frame 104 is lowered for purposes of reducing the size and weight of the throttle body 100, the throttle gear 43 can be received by the full-close stopper 12 because there is provided the projection 102*a* for mounting the full-closed stopper 12 over the height of the frame 104 and the throttle stopper 12 is installed on the projection 102*a* at the same mounting level as the throttle gear (the final gear) 43.

(4) Since the return spring 7 and the default spring 8 can be mounted by utilizing a free space inevitably formed around each of the bosses 101, 43*c* and 6*f*, rational utilization of space is realized. Moreover, since the boss 43*c* of the throttle gear 43 is protrusively formed on one side only, the amount of projection of the boss (the length of boss axis) protruding out from one side of the throttle gear 43 can be made longer than the amount of projection of the boss on one side of double-sided bosses (bosses protruded on both sides of the final gear). Therefore, it becomes possible to provide the default opening setting mechanism mounting space without wasting the space while enabling downsizing the throttle device.

(5) Since the default lever 6 and the throttle gear 43 serve also as the default spring 8 stopper, a special collar member for receiving the default spring 8 can be dispensed with, which contributes towards simplification of component parts.

The default lever 6, at least in a portion forming the boss 6*f* and a portion receiving the default spring 8, is made of a synthetic resin. Therefore, if the default spring 8 is distorted by the relative rotation of the default lever 6 and the throttle gear 43, it is possible to reduce friction between the default spring 8 and the spring receiving section of the default lever 6 which is in contact with the default spring 8 and the boss section, to thereby reduce a burden on the motor. Furthermore, since the return spring and the default spring are coated on the surface with a friction coefficient reducing coating, the friction can be decreased even when these springs are received at their one end by the metal throttle gear 43 and throttle body 100.

(6) Either the return spring 7 or the default spring 8 which has a large coil diameter is provided with a greater compressive stress F than the compressive stress f of the other spring having a small coil diameter, and, therefore, the default lever 6 can be pressed unidirectionally in a steady state in a position close to the outside diameter. The default lever mounted on the throttle valve shaft 3 can be held in a proper, stabilized state, thereby enabling to prevent lowering of the default opening accuracy.

(7) The throttle gear (the final gear) 43 serves also as a movable-side defining element for defining the mechanically full-closed position. Furthermore, because the defining element is pressed in and fixed on the throttle valve shaft 3, the throttle gear 43 is constantly held in a fixed position in relation to the throttle valve shaft 3 if applied with an impact when the throttle gear 43 hits against the full-closed stopper 12. Therefore, the controlled opening of the throttle valve set with reference to the mechanically full-closed position will not be adversely affected, thus doing much to maintaining the control accuracy.

(8) Adoption of flat surfaces in the motor housing and accordingly in the motor casing 110 contributes to the reduction of size and weight of the throttle body 100. Besides, of the flat inner surfaces of the motor casing 110, one inner surface 110*b* forms the outside wall surface of the intake air passage located downstream of the idle opening position for control of the throttle valve 2; therefore when a small amount of intake air is flowing like during idle operation, the flat surface 110*b* gains the most efficient cooling effect resulting from the adiabatic expansion of the intake air downstream immediately after passing the throttle valve 3 during idle rotation. Consequently, motor casing interior cooling effect and accordingly heat dissipation of the motor housing can be improved, contributing to the motor cooling effect.

(9) Furthermore, since one of the opposite flat inner surfaces of the motor case 110 is so formed as to be recessed below the surrounding outside wall surface of the intake air passage, the wall of the motor casing 110 located adjacently to the intake air passage 1 as shown in FIG. 14 is decreased in thickness in order to bring the inner surface 70*b* of the motor casing close to the intake air passage 1 side, thereby obtaining a better cooling efficiency of the intake air flowing in the intake air passage.

(10) The throttle sensor 30 can very easily be assembled simply by installing a complete set of component parts on the gear cover 103 side. As the gear cover 103 is mounted on the side wall of the throttle body 100, the forward end of the throttle valve shaft 3 goes into the shaft hole of the rotor 32 of the throttle sensor 30, and therefore the throttle valve shaft 3 and the throttle sensor 30 also can easily be engaged with a single motion. Furthermore, the throttle sensor 30, being invisibly covered with the sensor cover 31 inside of the gear cover, is protected from dust; that is, entry of dust and worn particles of components into the throttle sensor 30 can be prevented if the gear cover 103 is either in an attached or detached state, whereby improving the reliability of the sensor.

(11) In the shaft hole 37 of the rotor 32, one end of the throttle valve shaft 3 fits with the elastic deformation of the spring 38 installed in the shaft hole 37. The rotor 32 is retained by the rotor retaining spring 34 interposed between the rotor and the sensor cover 31, and therefore the rotor is constantly held in a given position even in case of throttle valve shaft vibration, thus reducing variation (chattering) of the throttle sensor output. Furthermore, it is possible to insure smooth rotation of the rotor in relation to the rotation of the throttle valve shaft, thereby enhancing responsivity of the sensor output.

(12) An inspection jig is engaged with the end portion 3*b* of the throttle valve shaft 3 located on the far side of the throttle sensor to give a turning torque from outside, thereby enabling to check the output characteristics of the throttle sensor.

(13) Embedded in the gear cover 103 are connector terminals 80*a*' and 80*b*' for connection with an external power source, conductors 80 of the connector terminals 80*a* and 80*b* for connection with the motor terminal 51, and conductors 81 of the sensor output terminals 81*a* to 81*d* and their connector terminals 81*a*' to 81*d*'; it is, therefore, possible to dispense with wiring operation for connection to these terminals. Moreover, attaching the gear cover 103 on the throttle body 100 enables easy connection of the connector terminals 80*a* and 80*b* on the gear cover side connected with the external power source through the joint-type connecting hardware 82 in the gear to the motor terminal 51 on the throttle body 100 side.

(14) The terminal clamping plate 103-2 which is a part of the gear cover 104 is preformed, and the conductors 80 and 81 are embedded at the time of resin-molding the plate 103-2. In this manner, the gear cover 103 can be formed by resin-molding without misalignment of the conductors 80 and 81.

Industrial Field of Utilization

This invention has various advantages as heretofore explained. In the electronically controlled throttle device equipped with the electric actuator, the gear mechanism, and the default opening setting mechanism, these advantages may be summarized as the realization of size and weight reduction, rationalization of fabrication and adjustment, operation stabilization, and accuracy improvement.

What is claimed is:

1. A throttle device for an internal-combustion engine which is driven by an electric actuator to open and close a throttle valve for controlling the amount of intake air aspirated by the internal-combustion engine; in said throttle device, a motor used as said electric actuator has two opposite flat surfaces in a yoke forming a motor housing; a motor casing for housing said motor has opposite flat inner surfaces conforming to the contour of said motor housing, and is disposed on the side wall of said throttle body in such a manner as to meet the line orthogonal to the axis of said throttle valve shaft; and, of said opposite flat inner surfaces of said motor casing, all or most part of one inner surface forms the outside wall surface of said intake air passage located downstream of said idle opening position for throttle valve control.

2. A throttle device for an internal-combustion engine according to claim 1, wherein, of said opposite flat inner surfaces of said motor casing, all or most part of one inner surface forms the outside wall surface of said intake air passage located downstream of said electrically full-closed position for throttle valve control.

3. A throttle device for an internal-combustion engine which is driven by an electric actuator to open and close a throttle valve for controlling the amount of intake air aspirated by the internal-combustion engine; in said throttle device, a motor used as said electric actuator has two opposite flat surfaces in a yoke forming a motor housing; a motor casing for housing said motor has opposite flat inner surfaces conforming to the contour of said motor housing, and is disposed on the side wall of said throttle body in such a manner as to meet the line orthogonal to the axis of said throttle valve shaft; and, of said opposite flat inner surfaces of said motor casing, one inner surface is recessed lower than the surrounding outside wall surface of said intake air passage.

* * * * *